US007530475B2

(12) United States Patent
Ophardt

(10) Patent No.: US 7,530,475 B2
(45) Date of Patent: May 12, 2009

(54) MULTIPLE COMPARTMENT COLLAPSIBLE BOTTLE

(75) Inventor: Heiner Ophardt, Vineland (CA)

(73) Assignee: GOTOHTI.COM Inc., Beamsville, Ontario (CA)

( * ) Notice: Subject to any disclaimer, the term of this patent is extended or adjusted under 35 U.S.C. 154(b) by 747 days.

(21) Appl. No.: 11/198,898

(22) Filed: Aug. 8, 2005

(65) Prior Publication Data

US 2006/0032865 A1 Feb. 16, 2006

(30) Foreign Application Priority Data

Aug. 9, 2004 (CA) ..... 2476977
Aug. 5, 2005 (CA) ..... 2514690

(51) Int. Cl.
*B65D 35/22* (2006.01)

(52) U.S. Cl. ..... 222/94; 220/666

(58) Field of Classification Search ..... 222/92–97, 222/106, 107, 100, 215; 220/666, 667, 685, 220/676, 6; 215/6, 383, 11.3; 383/85–91, 383/38–40

See application file for complete search history.

(56) References Cited

U.S. PATENT DOCUMENTS 3,727,803 A 4/1973 Cobb
3,810,503 A * 5/1974 Lewis et al. ..... 383/96
5,080,260 A 1/1992 During
5,083,678 A 1/1992 Waring
5,174,458 A 12/1992 Segati
5,255,808 A * 10/1993 Tobler ..... 220/6
5,316,184 A 5/1994 During
D350,070 S 8/1994 Ophardt et al.
5,337,923 A 8/1994 Lugez et al.
5,556,005 A 9/1996 Banks
5,609,899 A 3/1997 Spector
5,611,461 A 3/1997 Kubota et al.
5,731,021 A 3/1998 Spector
5,794,819 A 8/1998 Smith
5,836,482 A 11/1998 Ophardt et al.
5,921,440 A 7/1999 Maines
5,935,659 A * 8/1999 Cane et al. ..... 427/428.19
6,158,620 A 12/2000 Polan
6,170,712 B1 1/2001 Kasboske
6,419,783 B1 7/2002 Rainey et al.
6,523,330 B1 2/2003 Hurd
6,758,411 B2 7/2004 Conway et al.
7,357,267 B1 * 4/2008 Shimada et al. ..... 215/381

FOREIGN PATENT DOCUMENTS

WO WO 00/53504 9/2000
WO WO 03/033398 4/2003

* cited by examiner

*Primary Examiner*—Lien T Ngo
(74) *Attorney, Agent, or Firm*—Riches, McKenzie & Herbert LLP

(57) ABSTRACT

A collapsible bottle having at least two independent compartments each connected to provide communication with each other and, preferably, with a non-collapsible channelway leading to an outlet opening for the bottle.

25 Claims, 23 Drawing Sheets

23
26
31
25
41
22
27
28
33
43
56
30
60
40
56
62
61
64
63
56
5
5'
62
61
64
63
56
62
61
4
4'
56
56
32
24
42
31
23
41

MULTIPLE COMPARTMENT COLLAPSIBLE BOTTLE

SCOPE OF THE INVENTION

This invention relates to collapsible containers for fluids from which fluid may be dispensed in fluid containers and, more particularly, to a collapsible bottle having at least two collapsible compartments in communication with each other.

BACKGROUND OF THE INVENTION

Collapsible dispensers for soap and other fluids are known as for use, for example, in fluid dispensers such as that taught by the applicant's U.S. Pat. No. 5,836,482 entitled Automated Fluid Dispenser, issued Nov. 17, 1998, the disclosure of which is incorporated herein by reference. While the collapsible container may comprise a flexible bag which is not self-supporting, preferred collapsible containers comprise containers which are self-supporting as when filled with material yet are provided to collapse upon themselves. Such a collapsible container is, for example, illustrated in the applicant's U.S. Design Patent 350,070 and in FIG. 1 of U.S. Pat. No. 5,836,482 as comprising a bottle having a generally rectangular cross-section with side walls with folds provided therein such that opposing side walls become bent inwardly in a pleated manner towards each other facilitating the movement of opposite side walls inwardly towards each other.

A disadvantage of previously known collapsible containers is that the containers sometimes collapse in a manner which traps fluid therein. For example, whether a self-supporting container or a bag-like container, the collapsible container may collapse prematurely at an intermediate portion with the collapse at the intermediate portion preventing withdrawal from the container as from an outlet disposed at the bottom of the container of material in the container spaced from the outlet by the prematurely collapsed intermediate portion. This disadvantage is particularly acute when the fluid to be dispensed is expensive or under circumstances where the dispensing of fluid is critical to be maintained.

SUMMARY OF THE INVENTION

To at least partially overcome these disadvantages of previously known devices, the present invention provides a collapsible bottle having at least two independent compartments each connected to provide communication with each other and, preferably, with a non-collapsible channelway leading to an outlet opening for the bottle.

In one aspect, the present invention provides a collapsible container having an outlet opening and two collapsible tubular compartments, each compartment extending beside the other compartment from a respective open end of each compartment opening into the outlet opening away from the outlet opening to a respective closed end of each compartment, each compartment having a outboard side and an opposed inboard side with the inboard side of one compartment facing the inboard side of the other compartment, each compartment being collapsible from an inflated condition in which the container is filled with fluid toward a collapsed condition by the withdrawn of fluid from the outlet opening, wherein in the inflated condition, the inboard side and outboard side of each compartment are spaced, and wherein in collapsing from the inflated condition toward the collapsed condition the outboard side and inboard side of each compartment move relatively towards each other, a shunt bridging between the inboard sides of the compartments placing the two compartments in communication through their inboard sides.

In another aspect, the present invention provides a collapsible container having an outlet opening and two collapsible tubular compartments, each compartment extending beside the other compartment from a respective open end of each compartment opening into the outlet opening away from the outlet opening to a respective closed end of each compartment, each compartment having a outboard side and an opposed inboard side with the inboard side of one compartment facing the inboard side of the other compartment, each compartment being collapsible from an inflated condition in which the container is filled with fluid toward a collapsed condition by the withdrawn of fluid from the outlet opening, wherein in the inflated condition and the inboard side and outboard side of each compartment are spaced, and wherein in collapsing from the inflated condition toward the collapsed condition the outboard side and inboard side of each compartment move relatively towards each other, an elongate shunt located between the inboard sides of the compartments placing the two compartments in communication through their inboard sides along the length of the shunt with an end of the shunt open to the outlet opening, in collapsing of the compartments from the inflated condition toward the collapsed condition the shunt maintaining communication between the two compartments and the outlet opening substantially along length of the compartments.

In a third aspect, the present invention provides a collapsible container having an outlet opening and at least two collapsible tubular compartments, each compartment extending from a respective open end of each compartment opening into the outlet opening away from the outlet opening to a respective closed end of each compartment, each compartment adapted to collapse laterally with withdrawal of fluid from the outlet opening of the container, a central elongate shunt channelway located between the two compartments extending therebetween with an open end at one end open to the outlet opening, the channelway open laterally at a plurality of locations along its length to the each of the compartments at a plurality of locations along the length of each compartment, the channelway being substantially non-collapsible whereby the channelway maintains the two compartments in communication with the outlet opening along the length of the compartments as the compartments collapse.

In a fourth aspect, the present invention provides a collapsible container having an outlet opening and two collapsible tubular compartments, each compartment extending beside the other compartment from a respective open end of each compartment opening into the outlet opening, a shunt channelway between the compartments placing the two compartments in communication laterally at a plurality of locations along the length of the compartments from the open end substantially to the closed end.

In another aspect, the present invention provides a thin walled collapsible container closed but for an opening from an outlet end, the outlet end merging with front, rear and two side walls extending longitudinally of the container away from the outlet end to a closed base end, the front wall and rear wall each carrying a respective front and rear valley having side valley walls extending centrally into each front and rear wall towards a respective other of the rear and front wall to a respective front and rear valley valley apex each extending longitudinally of the container, each of the front and rear valley extending continuing from the base end towards the outlet end toward the outlet end, the front and rear valley apex spaced from each other and providing a channelway therebetween along their length from the base end toward the outlet end in all collapsed and uncollapsed conditions of the container.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
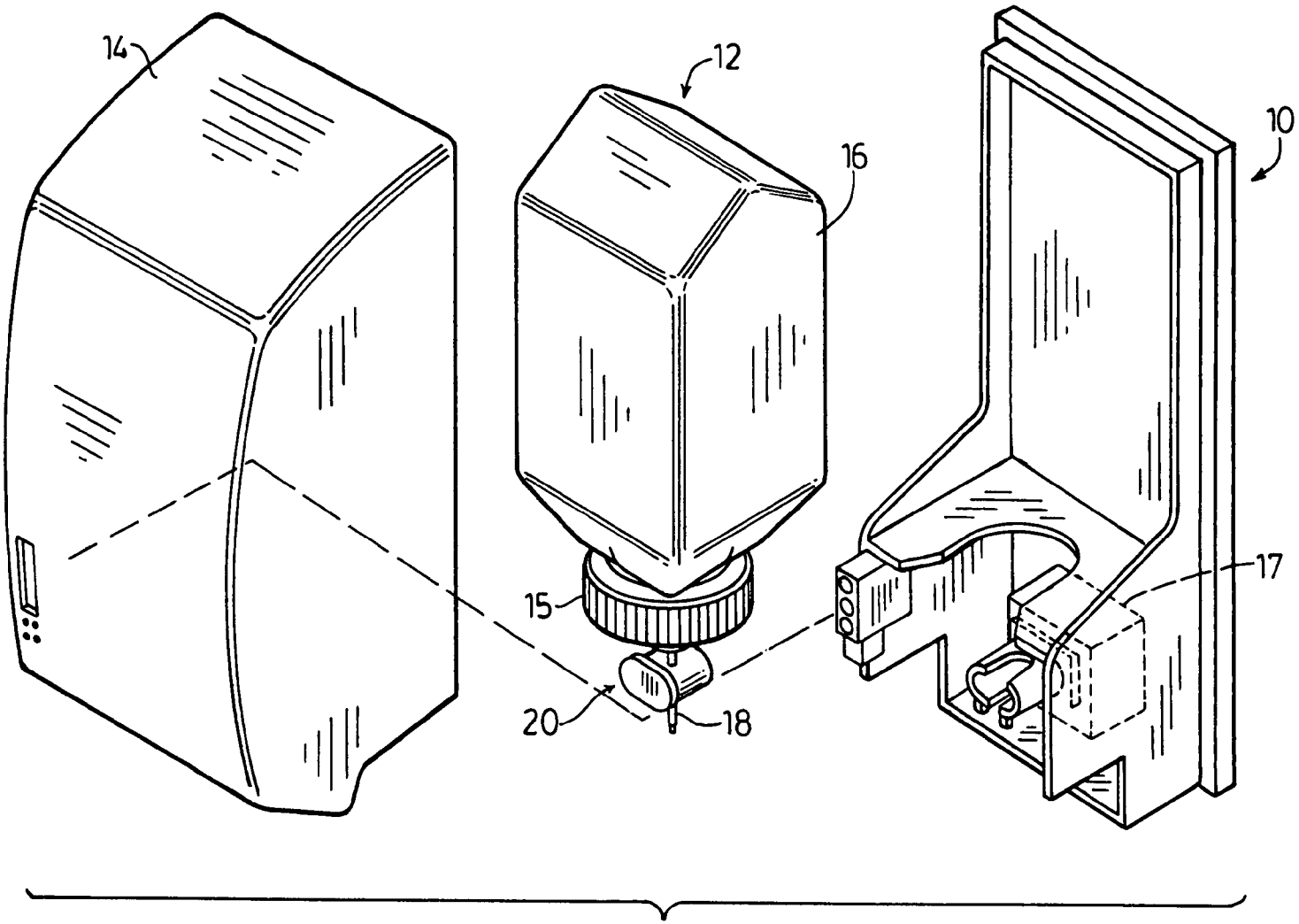
FIG.1 (PRIOR ART)
FIG. 1 is an exploded pictorial view of a prior art dispenser.
Figure 2:
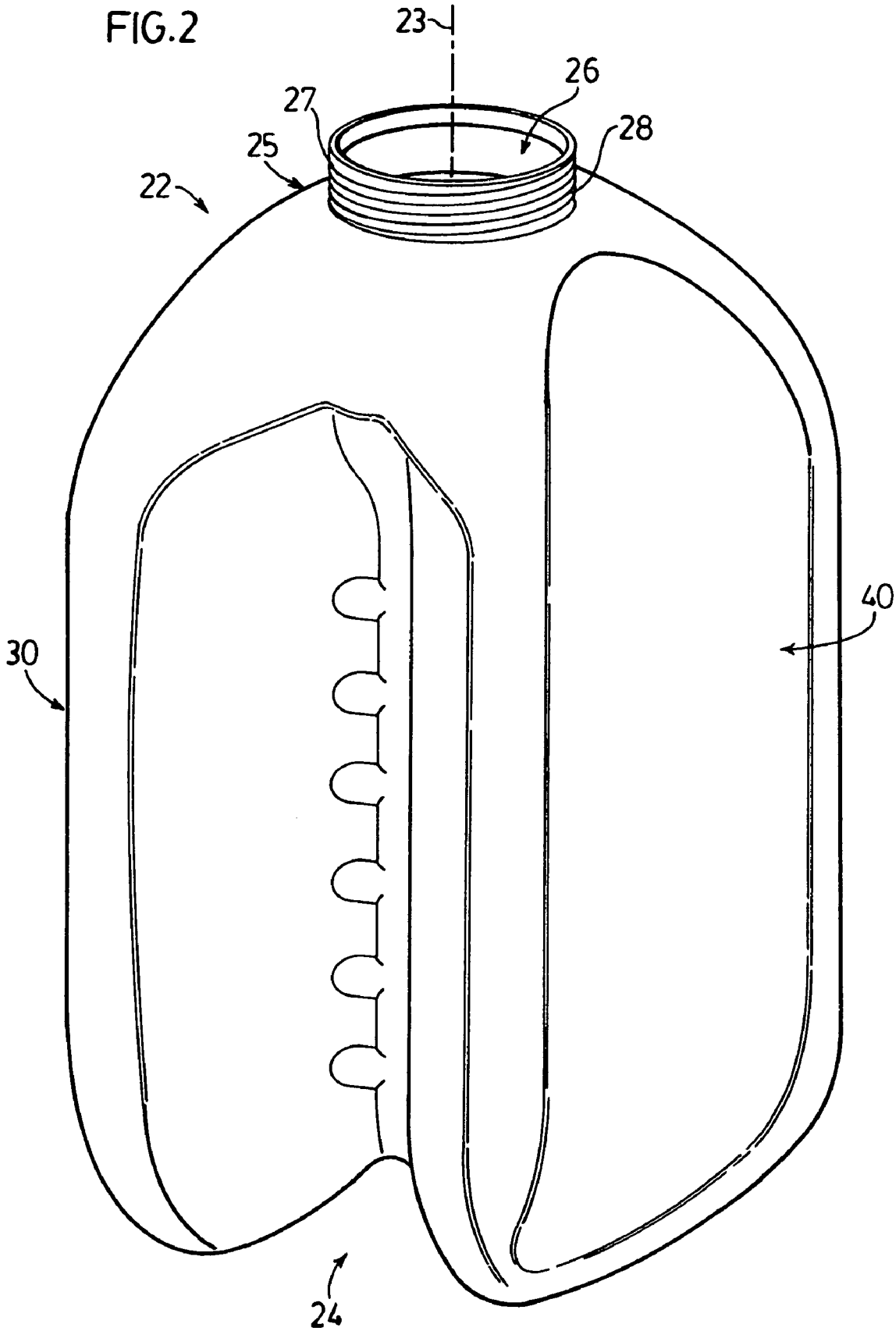
FIG. 2 is a pictorial view of a collapsible bottle in accordance with a first embodiment of the present invention.

Reference is made first to FIG. 1 which illustrates an exploded pictorial view of a prior art dispenser similar to that taught in U.S. Pat. No. 5,836,482. The dispenser comprises a support plate 10 for mounting to a wall, a replaceable sealed reservoir and pump unit 12 and a housing cover 14. The reservoir and pump unit 12 is adapted to be horiztonally removably slidably engaged on the support plate 10, following which the cover 14 may be secured to the support plate 10 to hide the reservoir and pump unit 12 and the workings of the dispenser from view. The reservoir and pump unit 12 comprises a collapsible container 16 having an outlet opening about which a closure cap 15 is secured. The closure cap 15 carries a replaceable, disposable pump 20 adapted to be coupled and driven by a motor 17 carried by the support plate 10 for dispensing fluid from an outlet nozzle 18 as when a person's hand is sensed below the nozzle by an infrared sensing system not shown. While the prior art dispenser shown is for automated dispensing, prior art collapsible containers 16 are also known for use in manual dispensing as with a manually operated pump disposed in its outlet as taught by U.S. Pat. No. 5,676,277 to Ophardt, issued Oct. 14, 1997, the disclosure of which is incorporated herein by reference.

In dispensing of fluid from the container 16, the container is to collapse upon itself.

Reference is made to FIGS. 2 to 7 which illustrate a first embodiment of a collapsible container 22 in accordance with the present invention. The container 22 is illustrated to extend along a central axis generally indicated 23 from a closed end 24 to an open end 25. The container has an outlet opening 26 at the open end 25 with the container having a cylindrical neck 27 about the outlet opening 26 carrying external threads 28.

Figure 3:
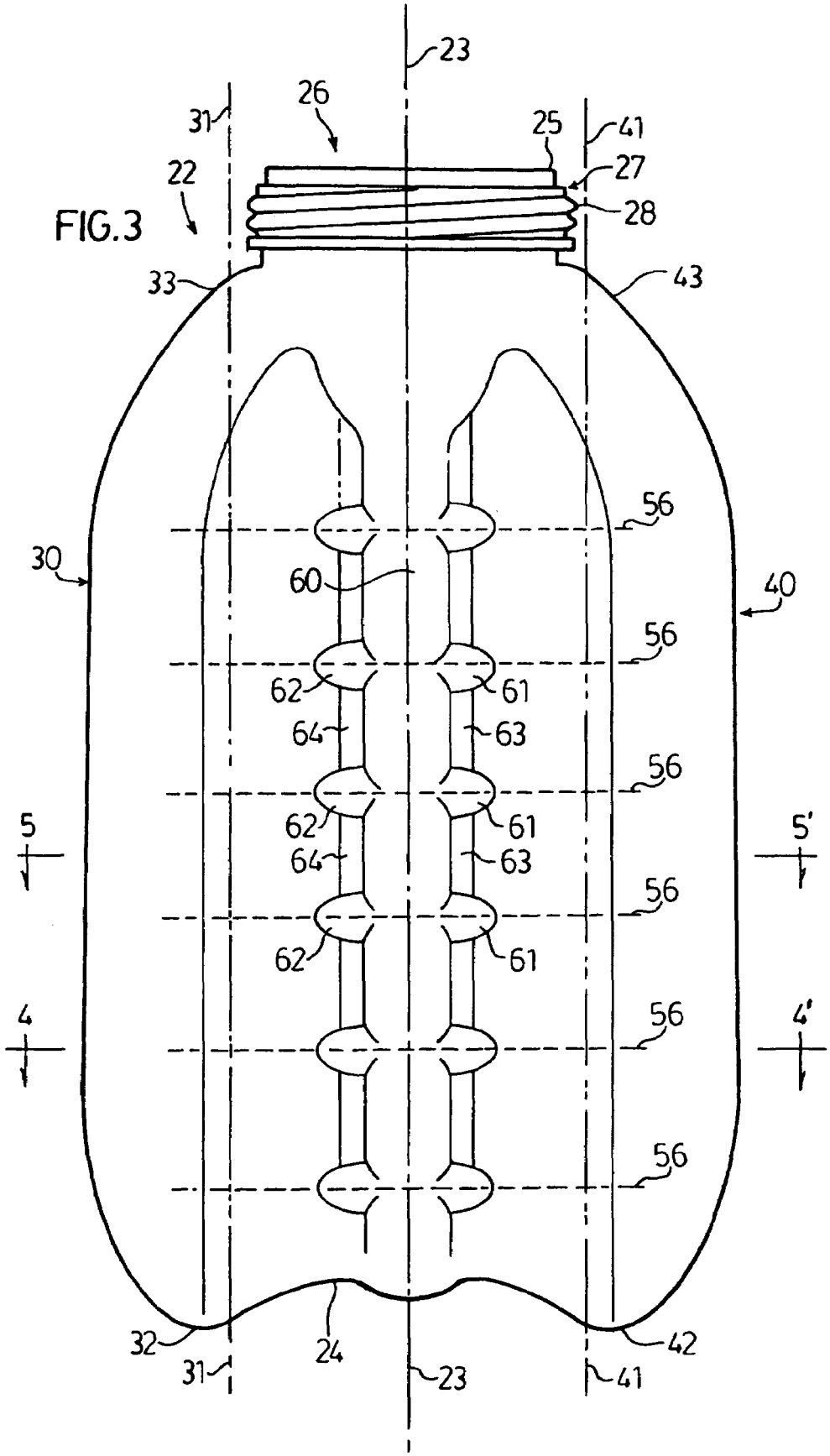
FIG. 3 is a side view of the bottle shown in FIG. 2.

The container 22 has two compartments 30 and 40, each of which extend generally about a respective container axis 31 and 41 beside each other from a closed end 32, 42 to an open end 33, 43 open to the outlet opening 26. The compartment axes 31 and 41 are shown in FIG. 3 as parallel to each other and parallel to the container axis 23 centered therebetween.

Figure 4:
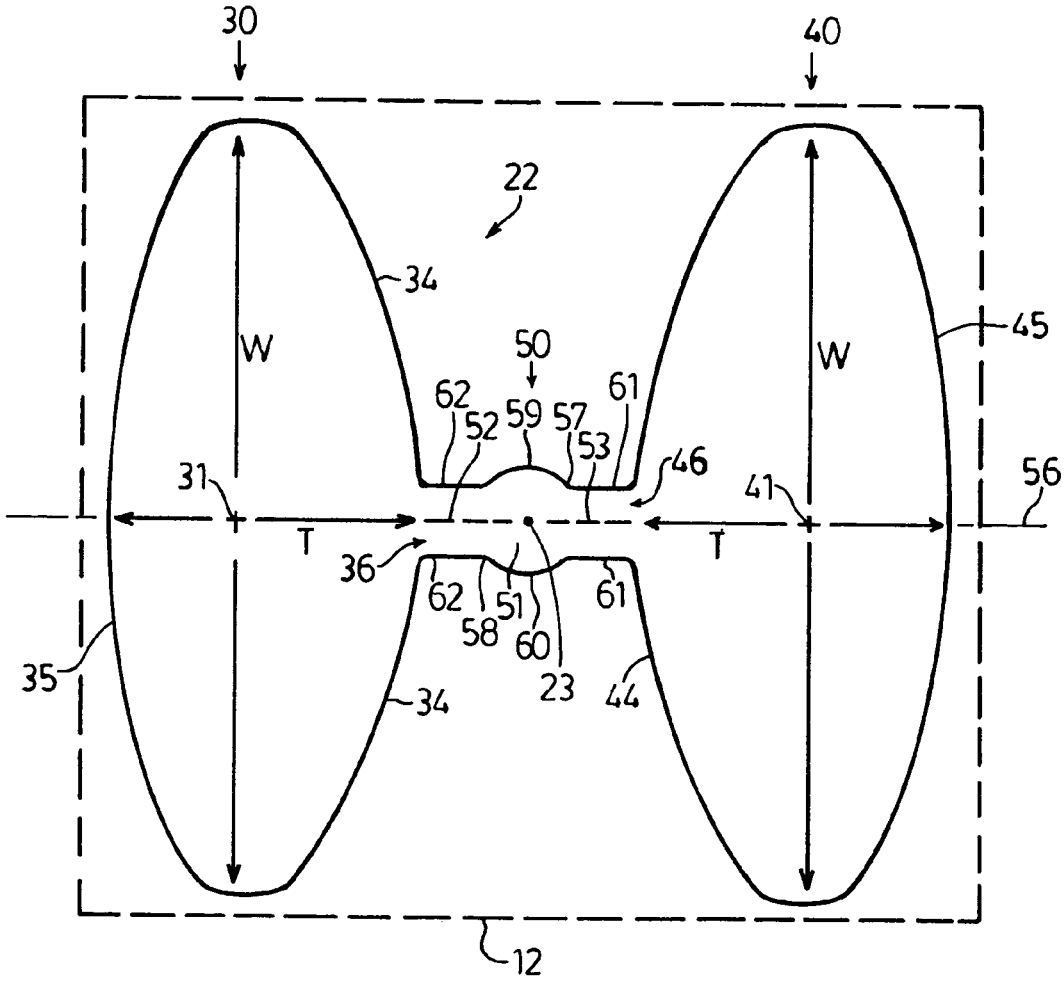
FIG. 4 is a cross-sectional view along section line 4-4' in FIG. 3.
Figure 5:
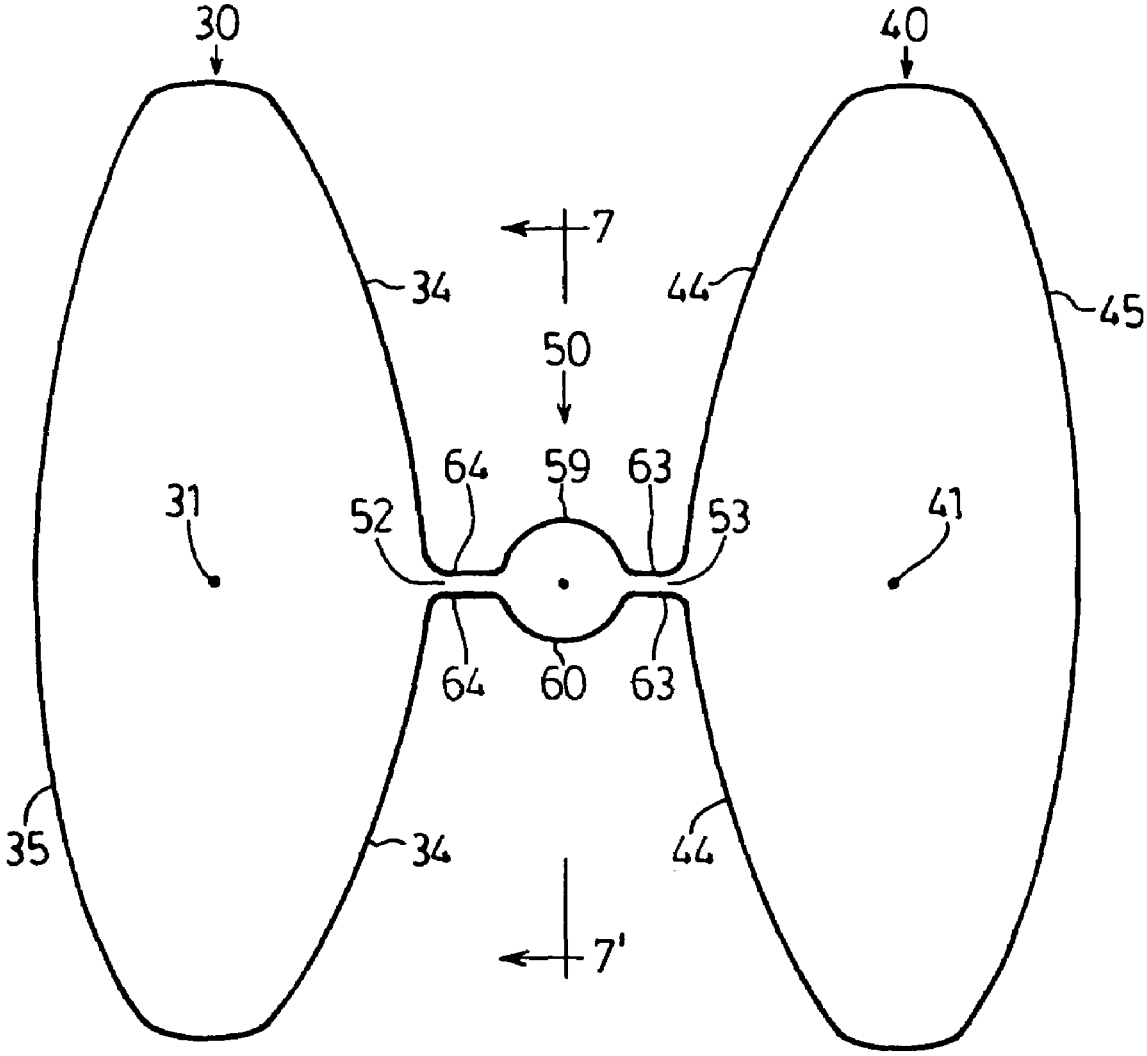
FIG. 5 is a cross-sectional view along section line 5-5' in FIG. 3.

As seen in FIG. 4, each compartment 30, 40 has an inboard side wall 34, 44 adjacent to the other compartment and an outboard side wall 35, 45 opposite from the respective inboard side walls 34 and 44.

A shunt member 50 couples the two compartments 30 and 40 together at their middle and provides for communication between the two compartments. The shunt member 50 comprises a cylindrical channelway 51 extending coaxially about the container axis 23. Two laterally extending slotways 52 and 53 extend from the channelway 51 through the inboard side walls 34, 44 of the compartments 30, 40 to provide communication between the interior of each compartment 30, 40 and the channelway 51. The slotways are widened at six locations as laterally extending cylindrical passageways best seen as 55 in FIG. 7 which extend, respectively, from the channelway 51 to the compartment 30 and from the channelway 51 to the compartment 40. The passageways 55 in the preferred embodiment are illustrated as being provided as pairs of passageways which extend about common passageways axes 56 best seen in FIGS. 3 and 4 normal to the container axis 23 at axially spaced locations.

The shunt member 50 is formed between two spaced side walls 57 and 58 which bridge between the inboard side walls 34 and 44 of the compartments and with the inboard side walls 34 and 44 of the compartments defining openings 36 and 46 through the inboard side walls 34, 44 opening into the interior of the shunt member 50.

The side walls 57 and 58 have a part cylindrical portions 59 and 60 disposed about the container axis 23 where the side walls 57 and 58 border on the cylindrical channelway 51. The two spaced side walls 57 and 58 also have part cylindrical side wall portions 61 and 62 disposed about the passageway axes 56 where the side walls 57 and 58 are about the passageways 55. On each side of the part cylindrical portions 59 and 60 and between the spaced part cylindrical portions 61 and 62, the side walls 57 and 58 are generally planar as flat side wall portions 63 and 64 extending parallel to each other and spaced on either side from a plane containing the passageway axes 56 of each of the passageways and the container axis 23 such that slotways 52 and 53 are provided between the flat side wall portions 63 and 64 between the channelway 51 and each of the compartments.

The side walls 57 and 58 of the shunt member 50, each have a three-dimensional shape including the part cylindrical portions 59 and 60 and the part cylindrical portions 61 and 62. This three dimensional shape provides an inherent tendency to resist collapsing and provides for communication from the interior of each compartment 30 and 40 into the channelway 51 and via the channelway 51 axially to the outlet opening 26 at all times, even when the two compartments 30 and 40 may collapse upon themselves.

As seen in FIG. 4, each compartment 30 and 40 is indicated as having a thickness indicated as T and a width indicated as W. The thickness T is measured between the outboard side wall 35, 45 and the inboard side wall 34, 44 of each compartment normal to the compartment longitudinal axis 31, 41. The width W is measured normal to both the thickness T of the compartment and its longitudinal axis 31, 41. As seen in cross-section in FIG. 4 normal to the longitudinal axes 23, 31 and 41, each compartment is elongate in its width W relative to its thickness T. As seen in FIG. 4, the container has a generally H-shape in cross-section normal to the longitudinal axes with the shunt member 50 forming the cross member of the H-shape and each compartment 30 and 40 forming the legs of the H-shape. Each of the compartments 30 and 40 are generally tubular in configuration and extend beside each other.

Figure 6:
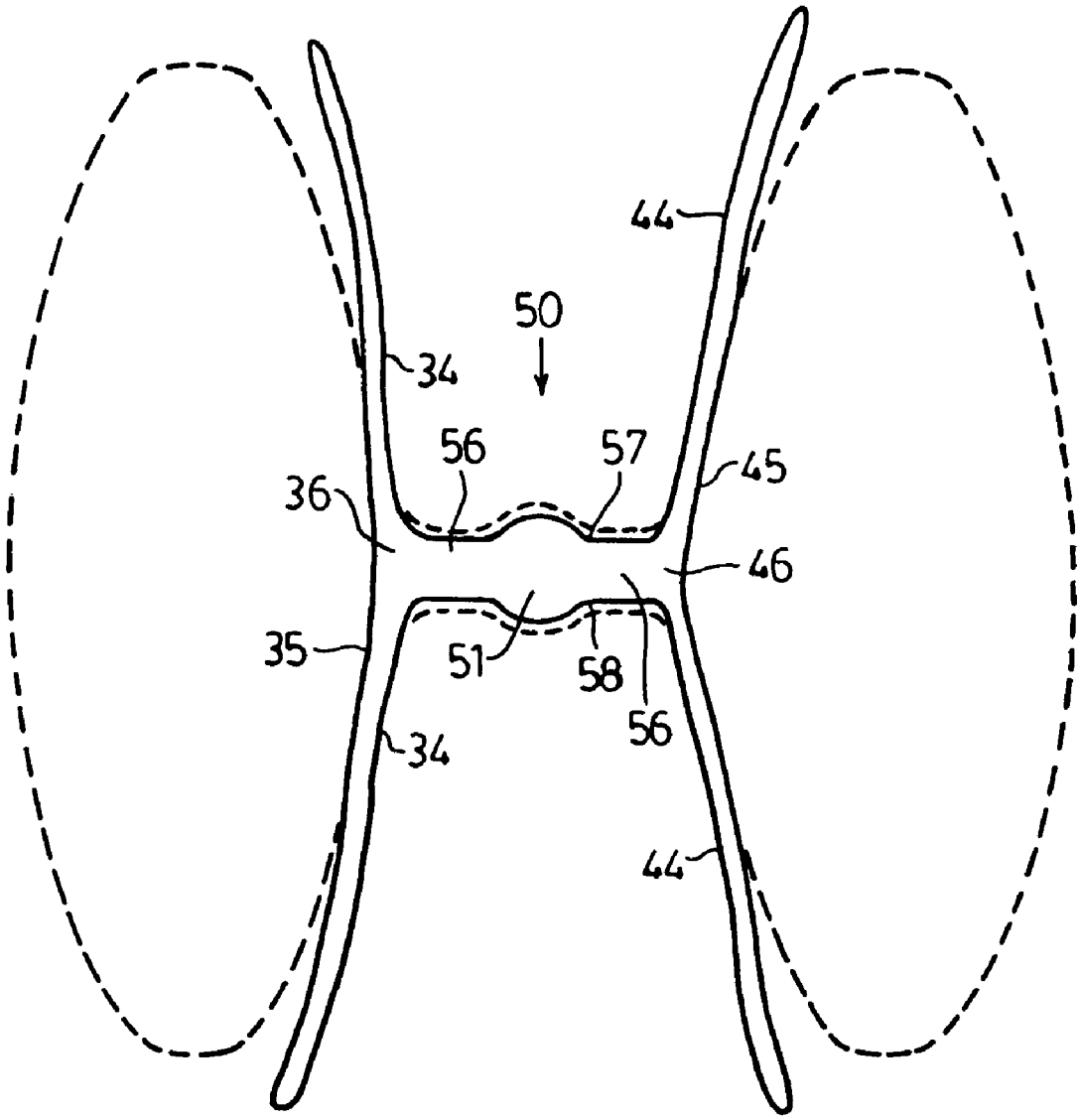
FIG. 6 is a cross-sectional view similar to that shown in FIG. 5, however, with the bottle in a collapsed condition.
Figure 7:
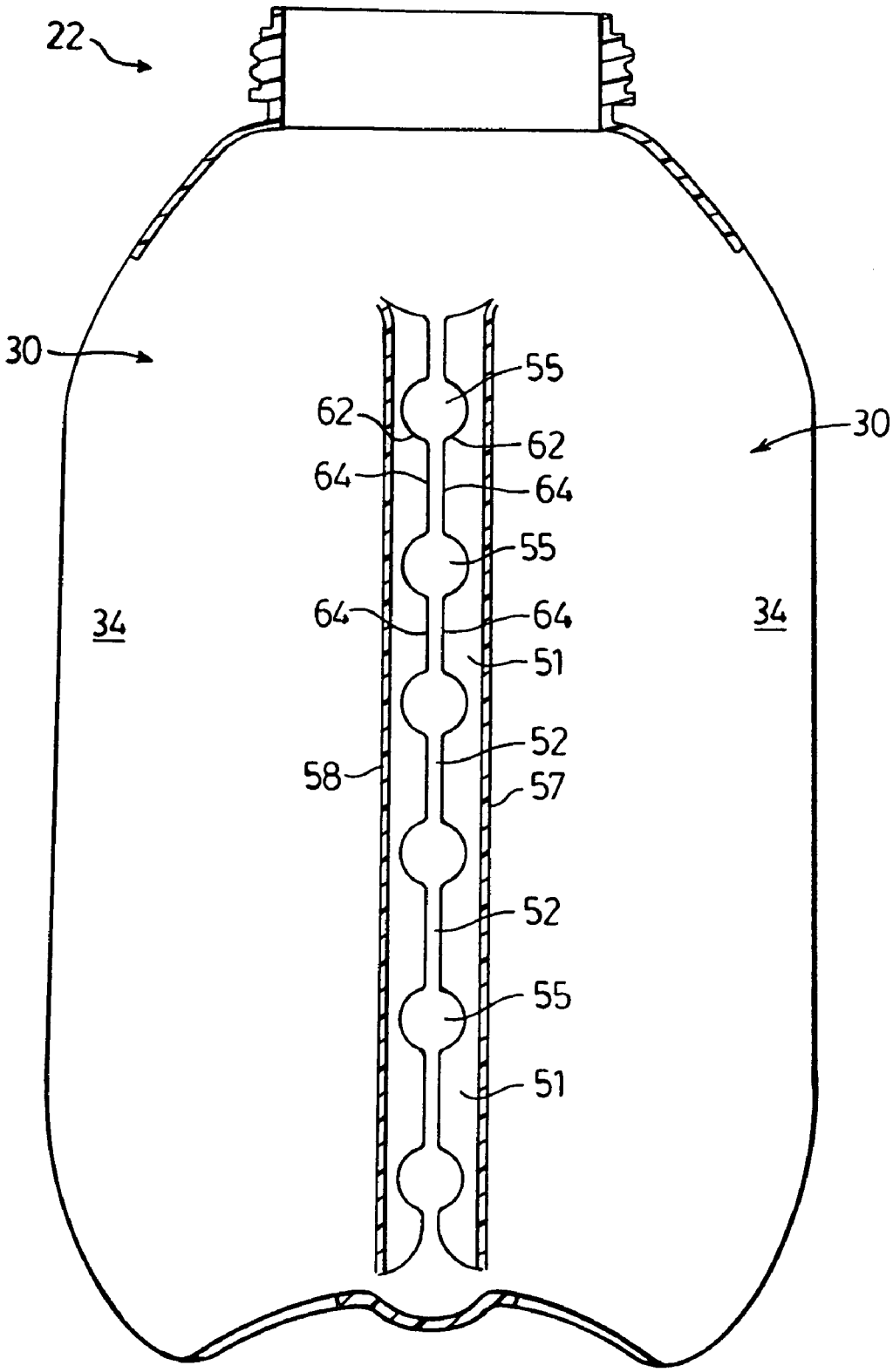
FIG. 7 is a cross-sectional view of a portion of the container along section line 7-7' in FIG. 5.

Reference is made to FIG. 6 which illustrates a cross-section the same as that in FIG. 4, however, shows in dashed lines a condition of the container 22 in FIG. 4 when in an inflated condition as filled with liquid and shows in solid lines the container 22 in a collapsed condition.

As seen in FIG. 6, in collapsing from the inflated condition of FIG. 4 towards the collapsed condition of FIG. 6, the outboard side walls 35 and 45 and the inboard side walls 34 and 44 move relatively towards each other so as to collapse upon each other. Each compartment 30 and 40, by reason of being elongate in its width W relative to its thickness T, has a predisposition to collapse in the manner as illustrated in FIG. 6 with the outboard side walls to move relatively towards the inboard side walls. The shunt member 50 does not collapse but continues to provide communication laterally from the central channelway 51 into the interior of each compartment 30 and 40 in all conditions of the containers 30 and 40 in collapsing from the inflated condition of FIG. 4 to the collapsed condition of FIG. 6.

In FIG. 6, the side walls 57 and 58 of the shunt member 50 are illustrated as being drawn together, for example, to an extent that the flat side wall portions 63 and 64 between the passageways 55 while not shown may be drawn together into abutment, however, the passageways 55 provide in a collapsed condition for the continued communication between the channelway 51 and the compartments 30 and 40. The container 22 may be configured such that on collapsing, the distance between the flat planar portions 63 and 64 of the side walls are not collapsed but at least may be maintained as, for example, by reason of the compartments 30, 40 being configured such that on collapsing with drawing of the outboard side walls 35, 45 inwardly, the inboard side walls 34, 44 have forces applied thereto which tends to draw the two halves of each inboard side wall on either side of the openings 36 and 46 away from the openings, thus tending to widen the openings 36 and 46.

Figure 8:
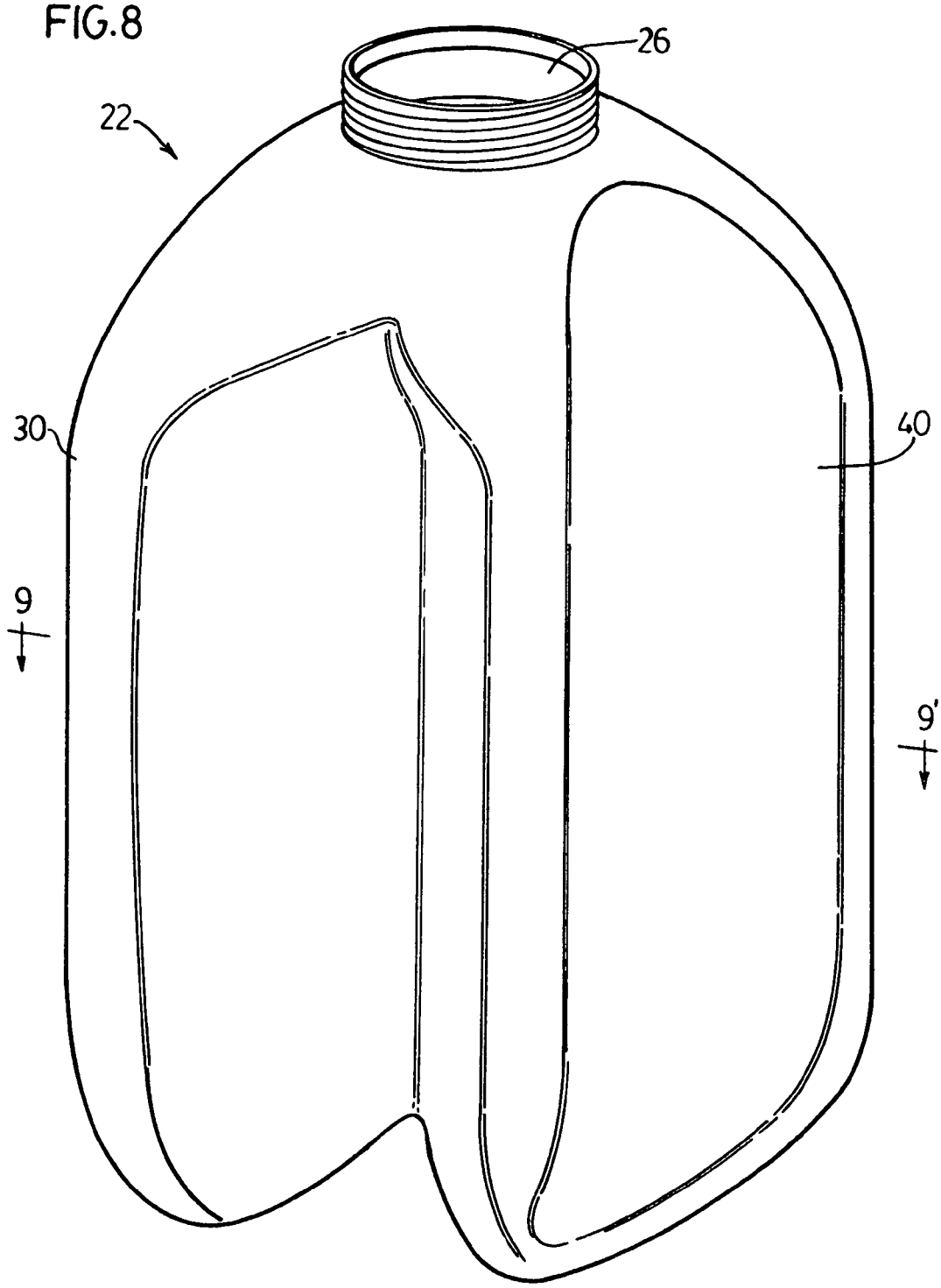
FIG. 8 is a pictorial view of a collapsible bottle in accordance with a second embodiment of the present invention.
Figure 9:
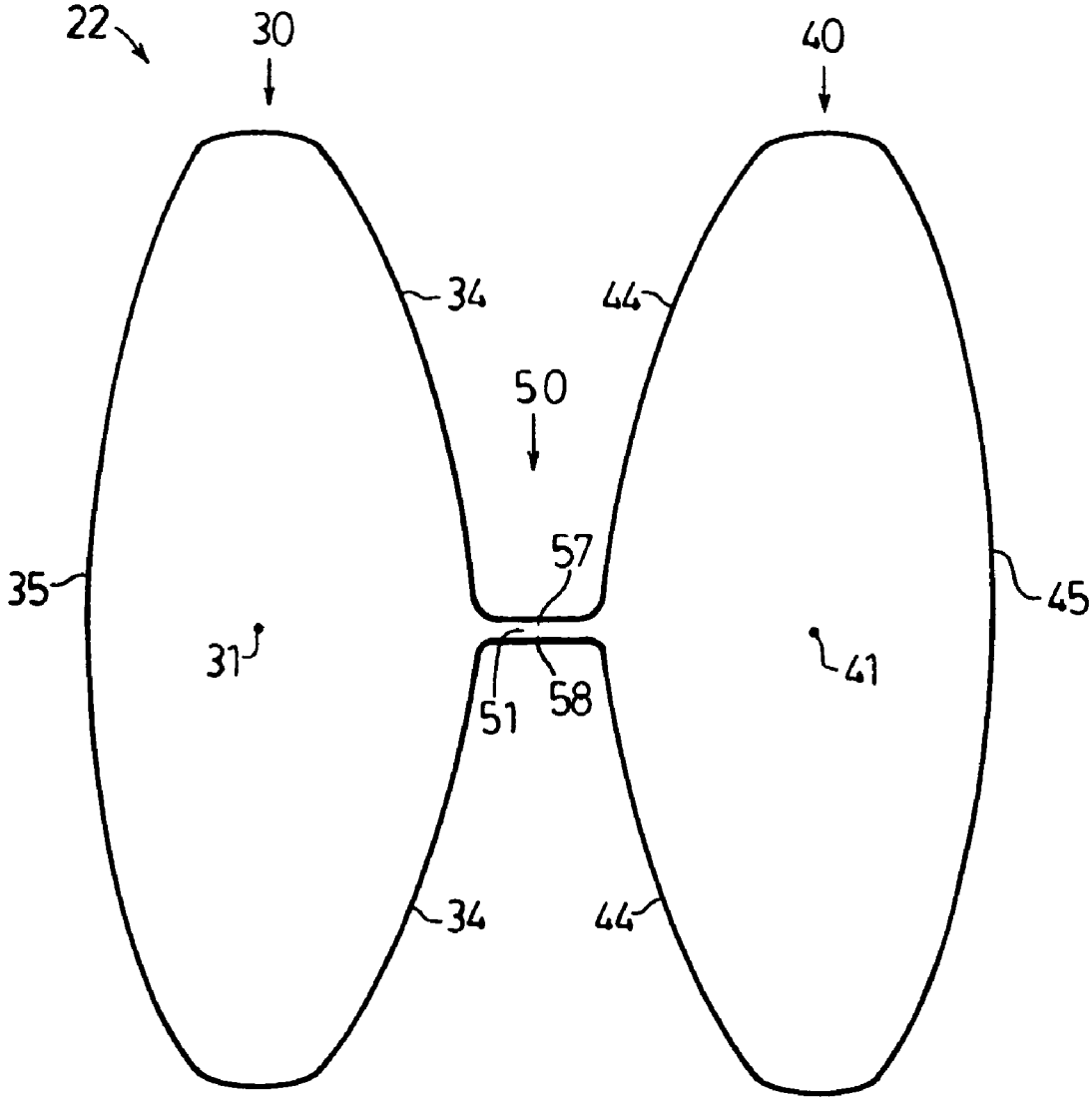
FIG. 9 is a cross-sectional view along section line 9-9' in FIG. 8.

Reference is made to FIGS. 8 and 9 which illustrate a second embodiment of a container 22 in accordance with the present invention. The container 22 illustrated in FIGS. 8 and 9 is substantially identical to that illustrated in FIGS. 1 to 5, however, has the shunt member 50 formed merely with its side walls 57 and 58 being flat and planar, each extending in a plane which is disposed parallel to a plane between the longitudinal axis 31, 41 of the compartments. The shunt member 50 provides a channelway 51 providing communication between the two compartments 30 and 40. Each of the compartments will collapse in a similar manner to that illustrated in FIG. 6. The embodiment illustrated in FIGS. 8 to 9 can be useful whether or not in collapsing of the container, the channelway 51 may collapse by having its side walls 57 and 58 drawn completely together. Even if the channelway 51 may collapse at any portion along its length, the channelway 51 provides the opportunity for communication between the compartments 30 and 40 at other locations and, thus, in the event of the premature collapse of an intermediate portion of one of the compartments along its length, an opportunity is still offered for flow of fluid which would otherwise be trapped in a separated portion of the compartment to be drawn laterally via the channelway 51 into the uncollapsed portion of another compartment. Therefore, in the absence of premature collapsing of the two intermediate portions of both compartments at the same location longitudinally, there is an increased opportunity for fluid to be drawn outwardly past a prematurely collapsed portion of one of the compartments.

Various configurations can be adopted to maintain a continuous communication laterally through the channelway 51 between the compartments in accordance with the embodiment illustrated in FIGS. 8 and 9. In one configuration, each of the compartments 30 and 40 is configured with their side walls arranged such that on collapse of a compartment, the two halves of the inboard side walls 34, 44 of each container are drawn away from the channelway 51 such that with collapsing, the spacing between the side walls 57 and 58 of the channelway 51 may increase or at least stays the same. This can be arranged by suitable selection of the shape of the compartment and the inherent flexibility of different portions of these side walls forming each compartment.

As contrasted with the second embodiment in FIGS. 8 and 9, the first embodiment illustrated in FIGS. 2 to 5, provides for the side walls 57 and 58 of the shunt member 50 to have a three-dimensional configuration which does not collapse and ensures there is communication between the compartments through the shunt member 50 even when the member is collapsed. In the embodiment illustrated in FIGS. 8 and 9, modifications may be provided so as to provide a three-dimensional structure to each side wall 57, 58 which prevents its collapsing and ensures that even in the event the side walls 57, 58 are drawn together that communication therebetween will still be permitted.

Preferably, a configuration is adopted for the side walls 57, 58 of the shunt member 50 such that in a collapsed condition, a minimum of fluid will remain in the shunt member 50 which cannot be dispensed.

The embodiment illustrated in FIGS. 2 to 5 illustrate communication conduits which extend vertically via the cylindrical channelway 51 and horizontally via the passageways 55. It is to be appreciated that similar passageways may be provided, for example, diagonally or in other directions.

The container 22 is preferably formed by blow molding and the container's compartments therefore preferably are formed in a manner such that by a conventional blow molding process, the blow mold may be conveniently opened for removal of the compartment.

In the preferred embodiments, the compartments are illustrated to have a cross-section when filled as illustrated in FIG. 4 which is substantially the same throughout a significant portion of the length of the container 22, however, with the thickness T of each compartment tapering towards the closed ends 32, 42. In accordance with a preferred aspect of the invention, the thickness T of each compartment may increase towards the open ends 33, 43 of each compartment and may reduce towards the closed ends 32, 42 and this can assist in selective collapsing of each container, first at its closed end and, subsequently, with collapsing progressively successively towards the open end. As well, the container may have its side walls formed in the blow molding process so as to have a thinnest wall membrane at portions proximate its closed end so as to facilitate initial collapsing proximate the closed end and to collapse successively towards its open end.

The container 22 may be adapted to be received within dispensers having, for example, housings configured to receive prior art containers such as 12 shown in FIG. 1 which have a predefined size and shape. For example, the prior art container 12 in FIG. 1 has a rectangular shape illustrated schematically with the dashed lines indicated as 12 in FIG. 4. The container 22 in accordance with the present invention is illustrated as being adapted to be received within this square shape and, therefore, adapted for use directly with the prior art dispenser, albeit providing for improved collapsing.

Collapsing dispensers in accordance with the present invention may, however, be provided to have various other cross-sectional and three-dimensional shapes.

Figure 10:
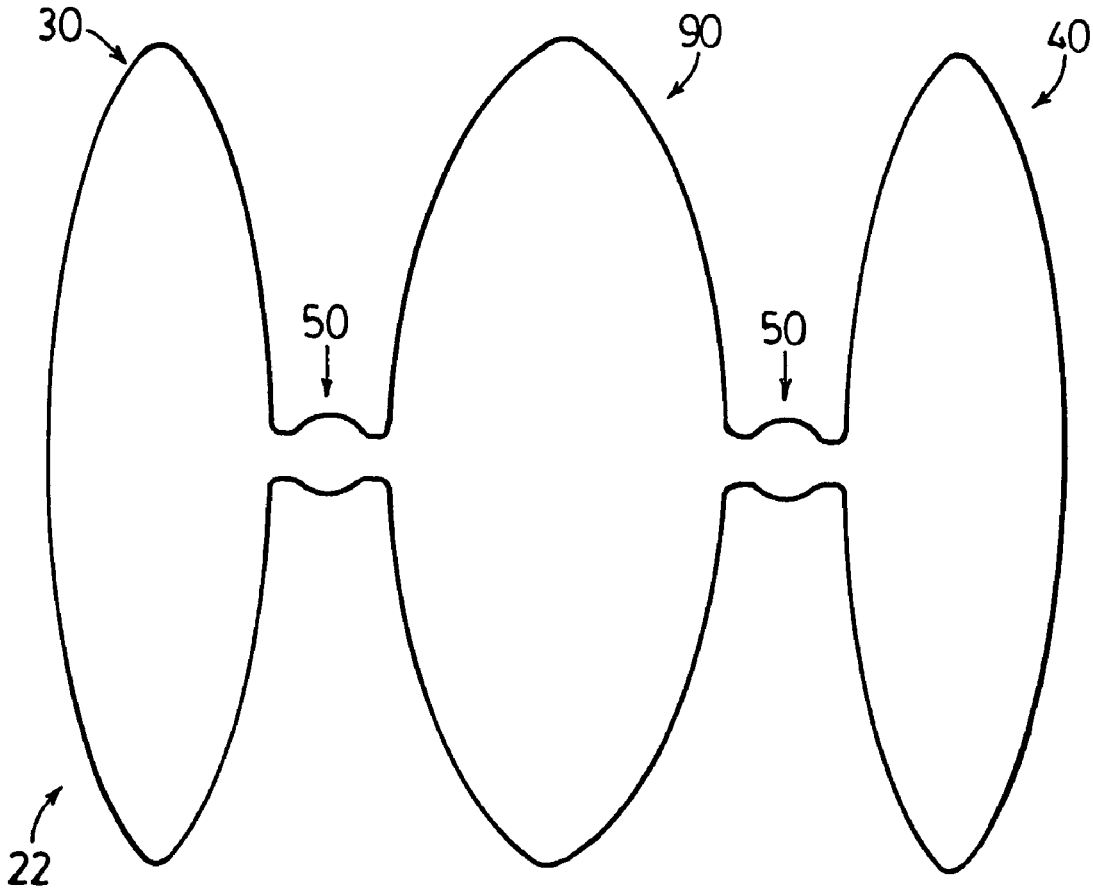
FIG. 10 is a cross-sectional view similar to that in FIG. 4 but through a collapsible bottle in accordance with a third embodiment of the present invention.

Reference is made to FIG. 10 which shows a third embodiment of a collapsible container 22 in accordance with the present invention. FIG. 10 schematically illustrates a cross-sectional view similar to that shown in FIG. 4 with the first embodiment. The embodiment in FIG. 10 schematically illustrates a container 22 similar to that shown in the first embodiment, however, in which three different compartments 30, 40 and 90 are illustrated with a third center compartment 90 intermediate compartments 30 and 40. Each compartment functions substantially the same as that illustrated in the first embodiment and two shunt members 50 are provided so as to provide communication between the interiors of each two adjacent compartments.

Figure 11:
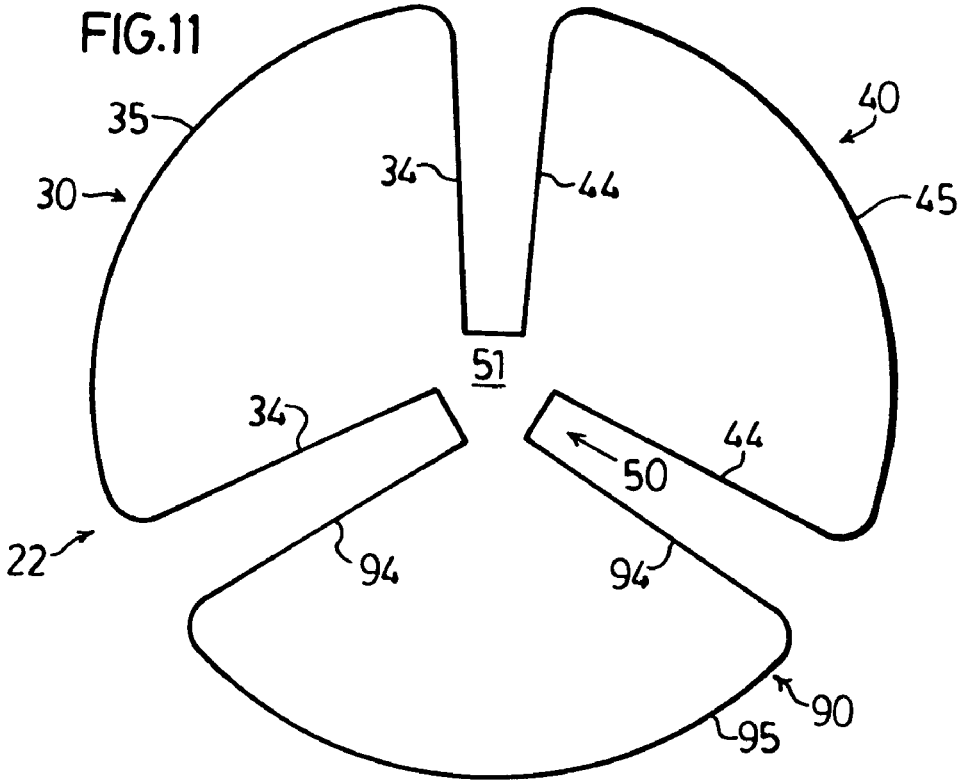
FIG. 11 is a cross-sectional view similar to that in FIG. 4 but through a collapsible bottle in accordance with a fourth embodiment of the present invention.

FIG. 11 illustrates a fourth embodiment of an invention in accordance with the present invention and illustrating a cross-sectional view similar to FIG. 4 but of a container 22 comprising three compartments 30, 40 and 90, each disposed aside each other but spaced about a central shunt member 50 having a channelway 51 opening laterally into each compartment. Each compartment is to collapse by its outboard side walls 35, 45 and 95 moving generally inwardly relative to the inboard side walls 34, 44 and 94.

Figure 12:
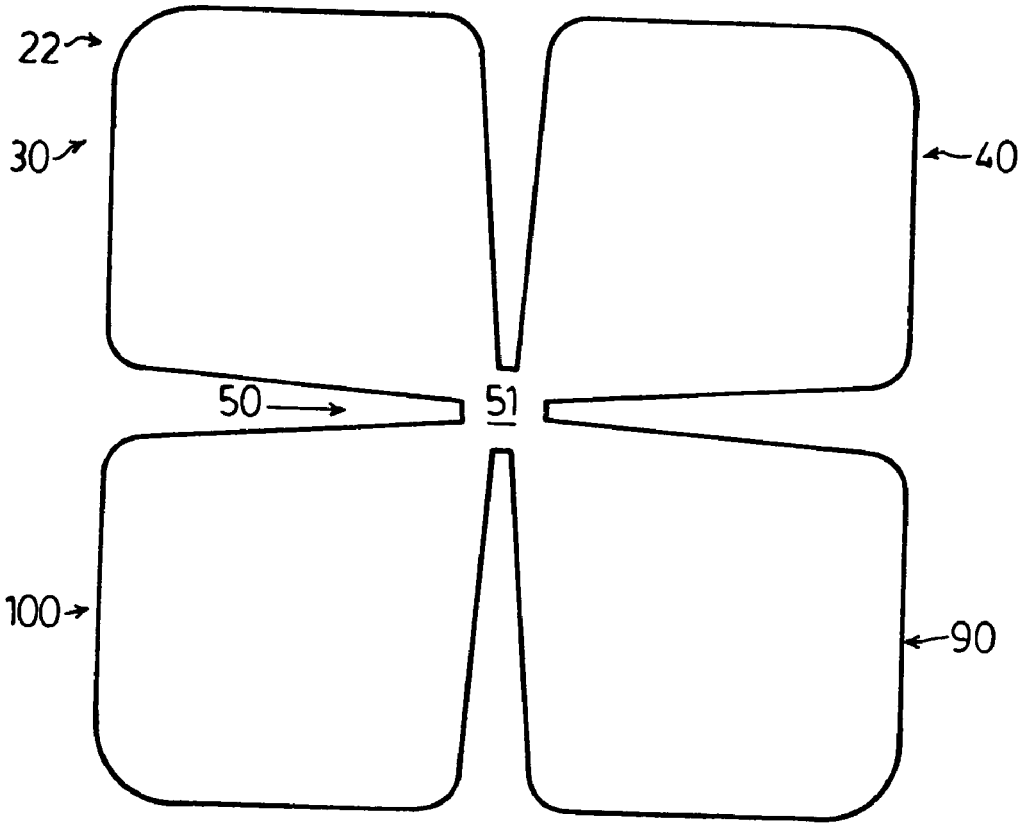
FIG. 12 is a cross-sectional view similar to that in FIG. 4 but through a collapsible bottle in accordance with a fifth embodiment of the present invention.

FIG. 12 illustrates a fifth embodiment in accordance with the present invention illustrating a cross-section similar to that in FIG. 4, however, in a container having four compartments 30, 40, 90 and 100, each adapted to separately collapse and with communication being provided between each of the compartments via a central shunt member 50 having a channelway 51 opening into each of the compartments.

Reference is made to FIGS. 13 to 21 which illustrate a container 22 in accordance with a sixth embodiment of the present invention.

Figure 13:
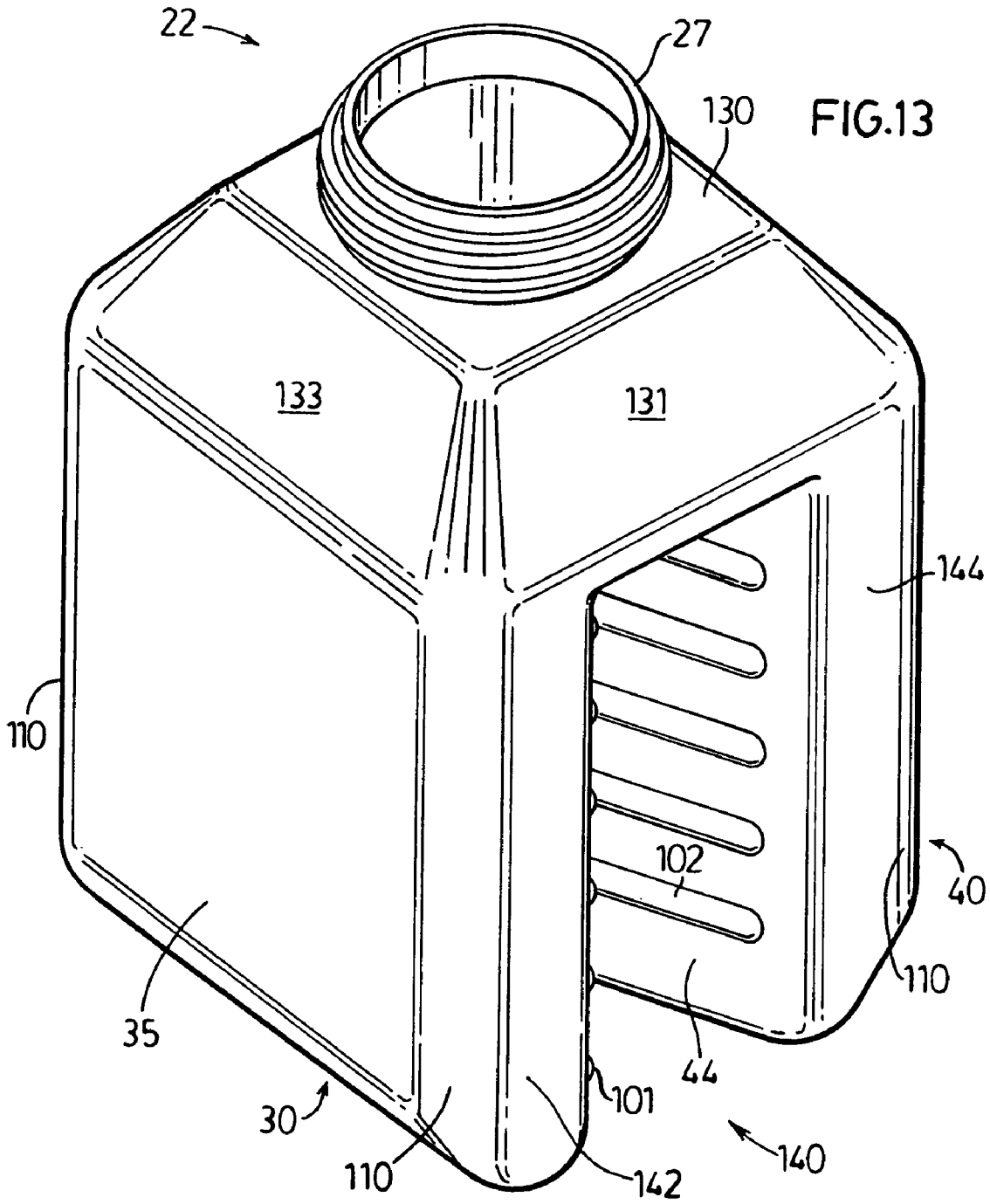
FIG. 13 is a first pictorial view of a collapsible bottle in accordance with a sixth embodiment of the present invention.
Figure 19:
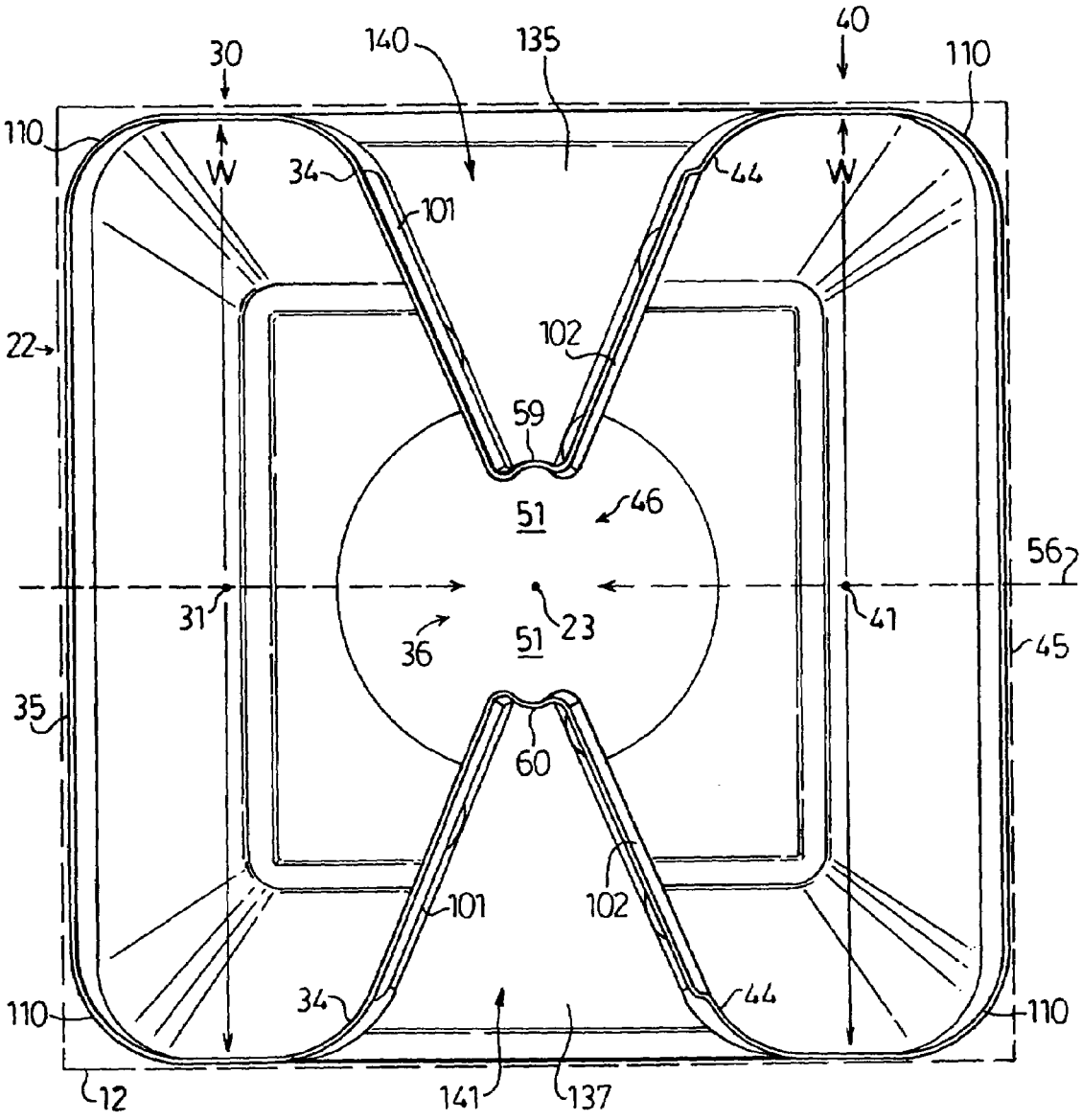
FIG. 19 is a cross-sectional view along section line A-A' in FIG. 16 with the bottle in an uncollapsed condition.

As with the other embodiments, the container 22 of FIG. 13 is a thin-walled container closed but for an opening at an outlet end. The container 22 of FIGS. 13 to 21 has similar features to container 22 of FIGS. 2 to 7, however, in a simplistic sense as best seen in FIG. 19, with the shunt member 50 reduced to merely axially extending cylindrical wall portions or axial channel members 59 and 60 bridging the inboard side walls 34 and 44. Each axially extending channel 59 and 60 is provided to be outwardly concave, that is, to provide a concave outward surface of the container. A plurality of laterally extending parts cylindrical wall portions or lateral channel members 101 and 102 are provided in each of the inboard side walls 34 and 44, communicating at their inner end with the axial channel members 59 and 60. Each laterally extending channel member 101 and 102 are provided to be outwardly concave, that is, to provide a concave outer surface of the container.

Figure 20:
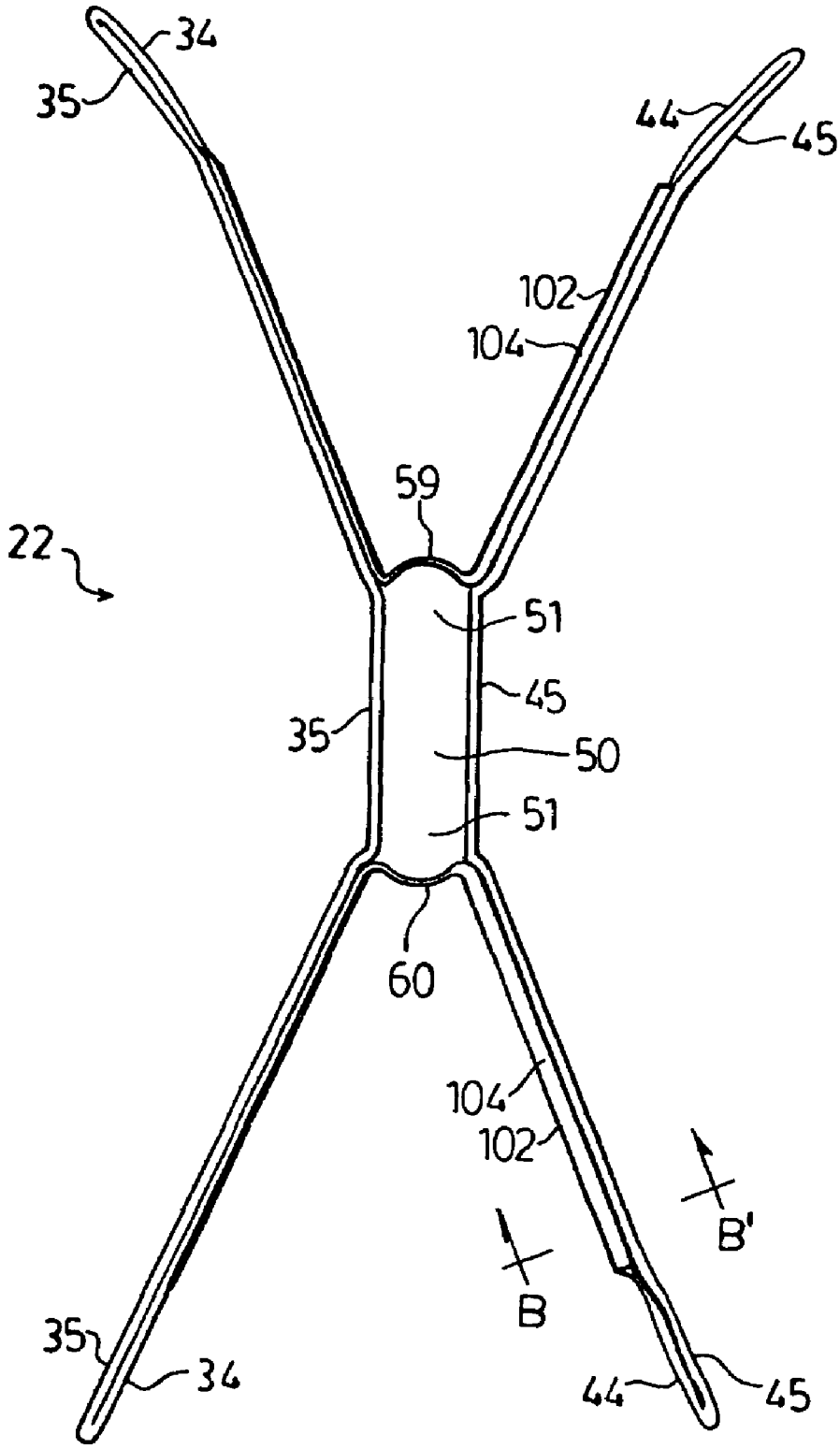
FIG. 20 is a cross-sectional view along section line A-A' as in FIG. 19 but with the bottle fully collapsed.

Referring to FIG. 20 which illustrates the container 22 of FIG. 13 in the collapsed condition, a channelway 51 remains open through the shunt member 50 aided by the axial channel members 59 and 60 not collapsing so that the outward walls 35 and 45 which collapsed to bridge between the axial channel members 59 and 60 are kept spaced apart from each other approximately the width of each of the axial channel members 59 and 60. Even if the outboard's walls 35 and 40 may be drawn together in the center between the axial channel members 59 and 60, an axially extending channelway 51 will be provided adjacent each of the axial channel members 59 and 60.

Figure 16:
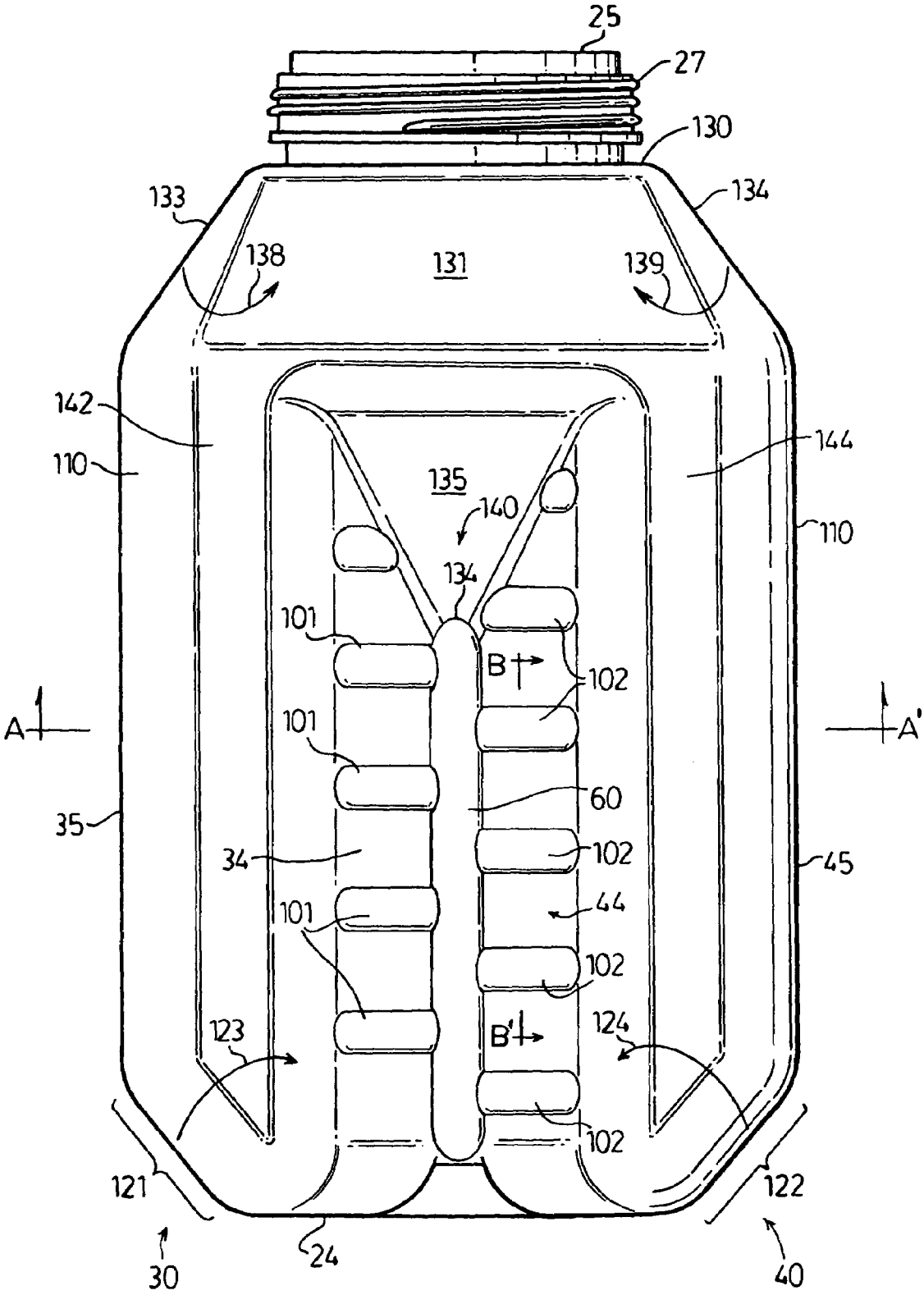
FIG. 16 is a front view of the bottle of FIG. 13.
Figure 17:
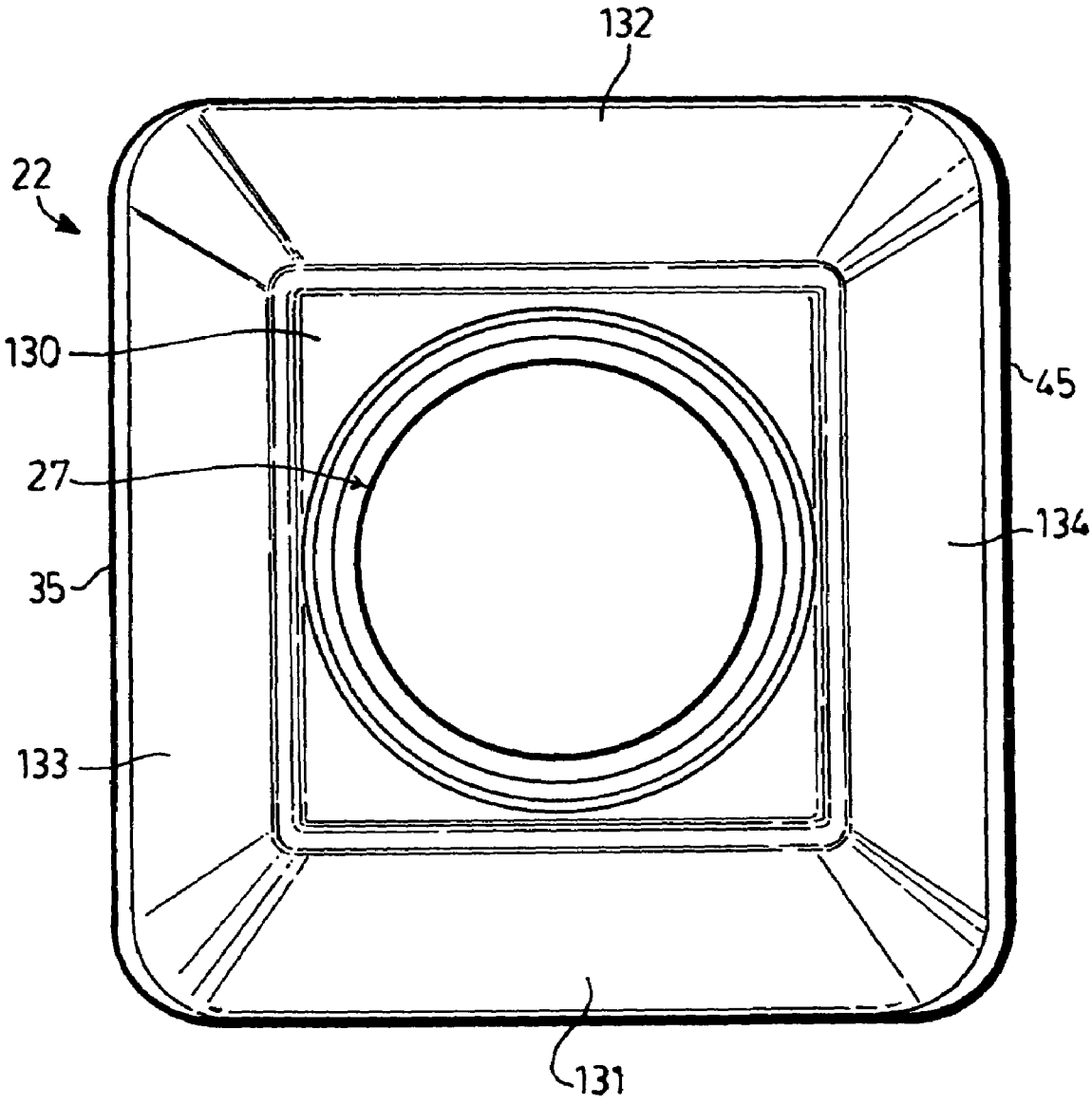
FIG. 17 is a top view of the bottle of FIG. 13.
Figure 18:
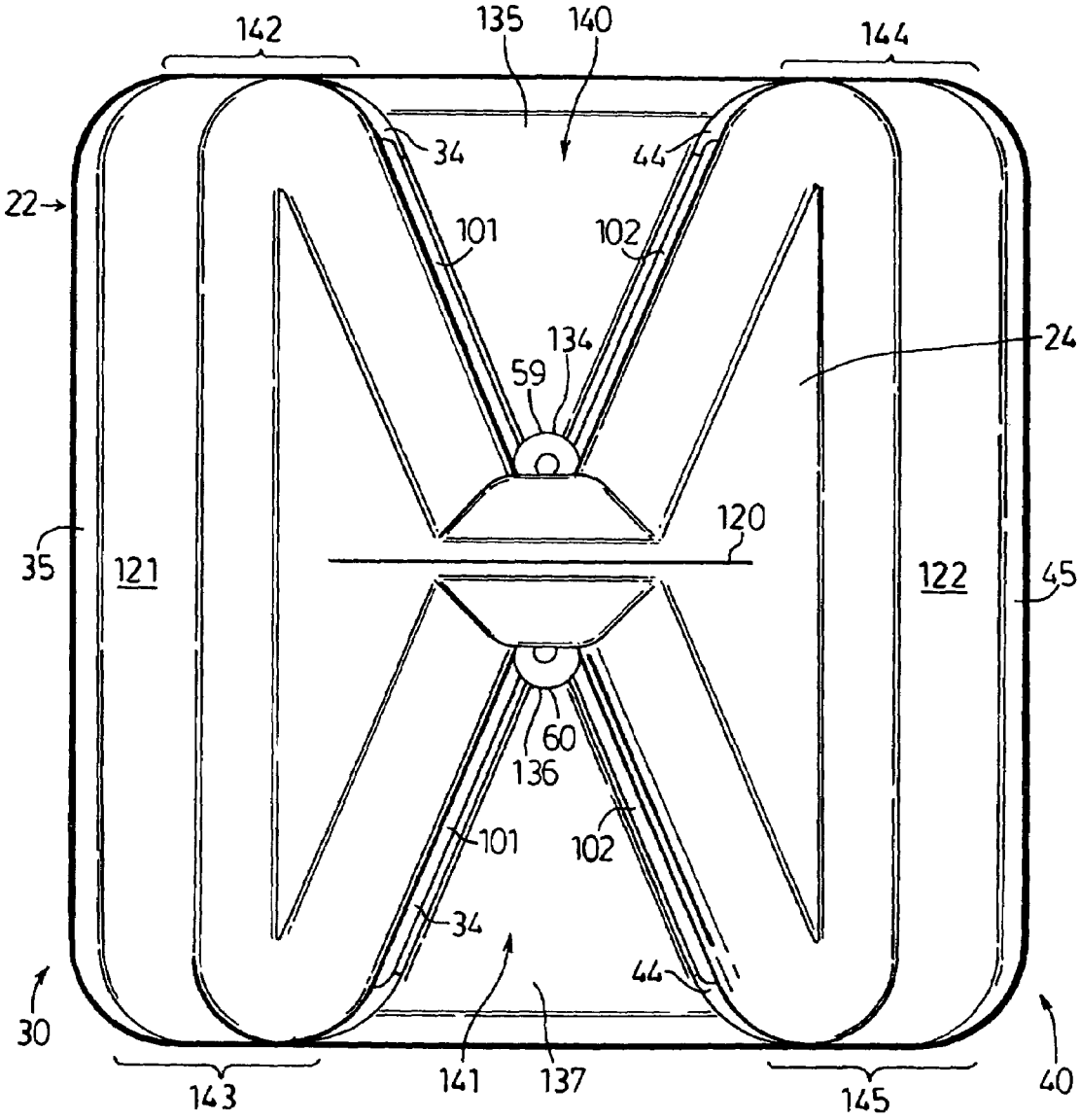
FIG. 18 is a bottom view of the bottle of FIG. 13.
Figure 21:
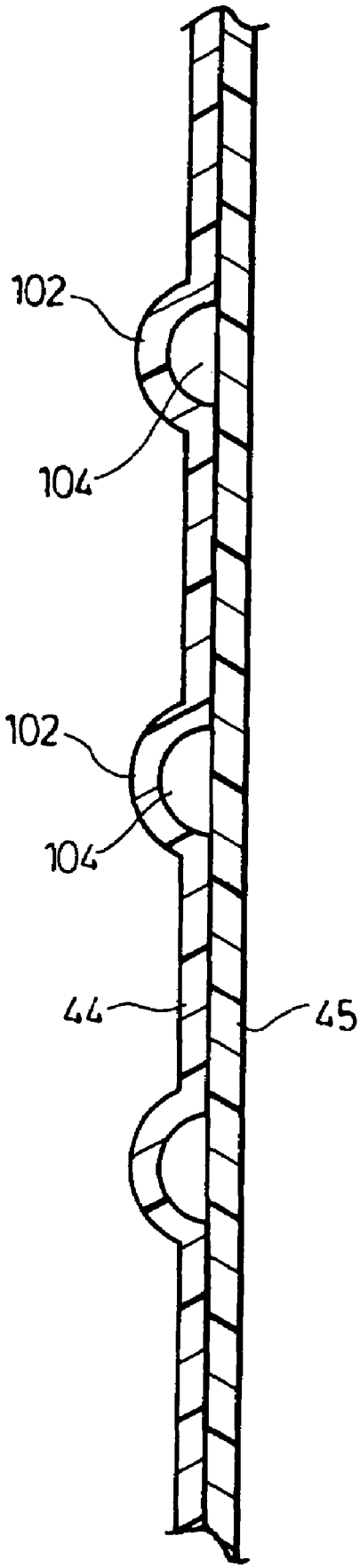
FIG. 21 is a partial cross-sectional view along section line B-B' in FIG. 20.

In FIG. 20, the compartment 30 is shown to have collapsed with its inboard side wall 34 abutting against its outboard side wall 35 laterally outwardly of the axial channel members 59 and 60. In FIG. 20, the compartment 40 is shown to have collapsed with its inboard side wall 44 abutting against its inboard side wall 45 laterally outwardly of the axial channel members 59 and 60. Since the cross-section A-A' in FIG. 20 is through a pair of lateral channel members 102, in collapsing of the compartment 40, with its inboard side wall 44 collapsed onto its outboard side wall 45, FIG. 20 shows two lateral channel members 102 carried on the inboard side walls 44 as providing a lateral channelway 104 between the inboard side wall 44 and the outboard side wall 45 open at its inner end to the axial channelway 5 1. FIG. 21 shows in another cross-sectional view the collapsed container 22 as in FIG. 20 along section line B-B' in FIG. 16 showing the outboard wall 45 collapsed against the inboard wall 44 and with the lateral channel members 102 providing the channelway 104 therebetween.

The lateral channel members 102 carried on the inboard side wall 34 also provides a lateral channelway 103 between the inboard side wall 34 and the outboard side wall 35, open at an inner end to the axial channelway 51.

The part cylindrical shape of the axial channel members 59 and 60 and the part cylindrical shape of the lateral channel members 101 and 102 resist their collapse under vacuum conditions in the container 22.

As seen in FIG. 19, the container 22 continues to be rectangular, and approximately square in outer cross-sectional shape with the container 22 of FIG. 19 holding increased volume in the same square space 12 compared to the container of FIG. 4. In cross-section as seen in FIG. 19, the compartments 30 and 40 have increased average thickness W as compared to the container of FIG. 2. The inboard walls 34 and 44 extend diagonally inwardly. The outboard side walls 35 and 45 are approximately planar and parallel to each other ending at curved side end portions 110 which merge into the lateral shoulders 142, 144, 143 and 145 of the front and rear walls and, hence, into the inboard side walls 34 and 44 which extend as planar members diagonally to the axial channel members 59 and 60.

Figure 14:
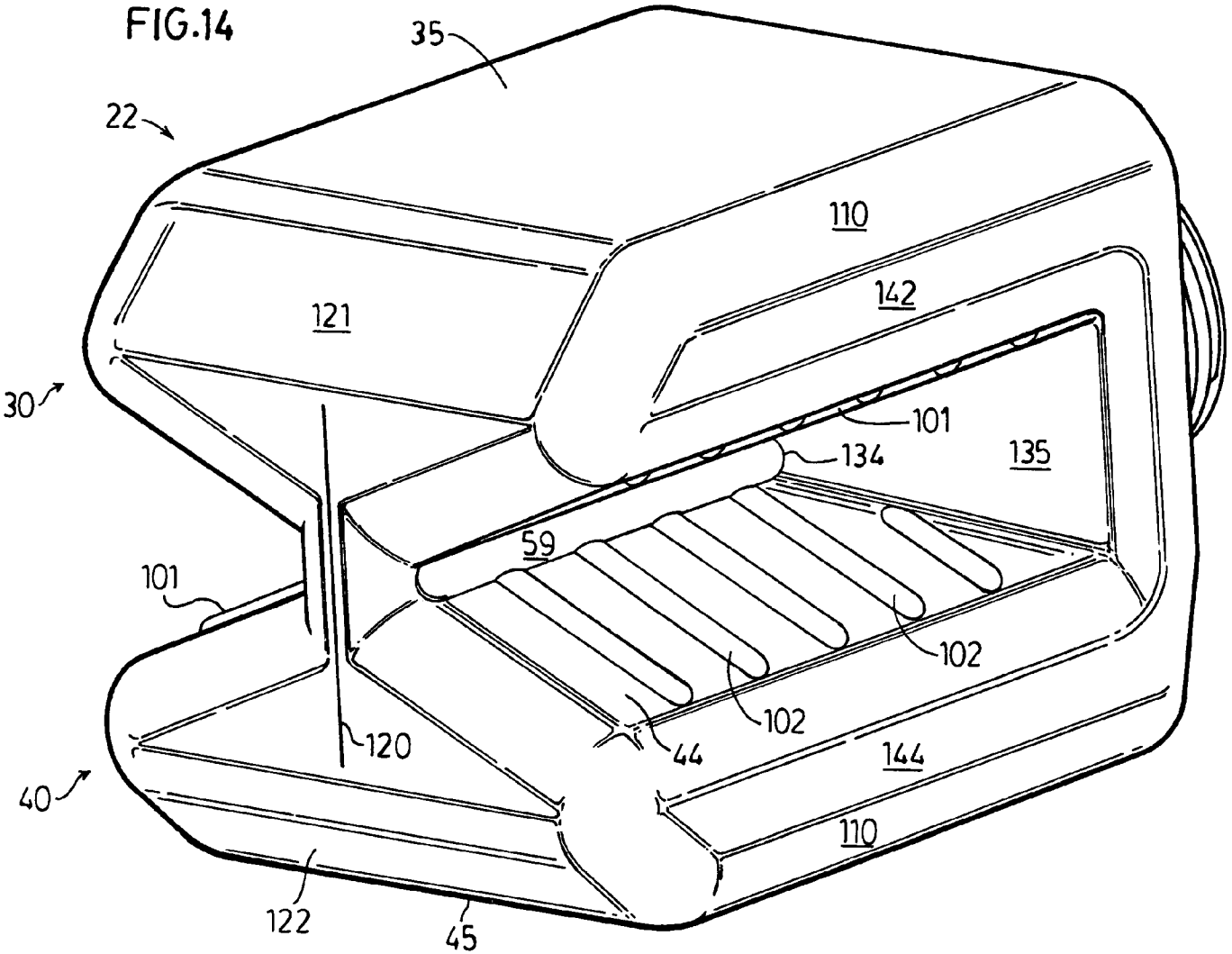
FIG. 14 is a second pictorial view of the bottle of FIG. 13.
Figure 15:
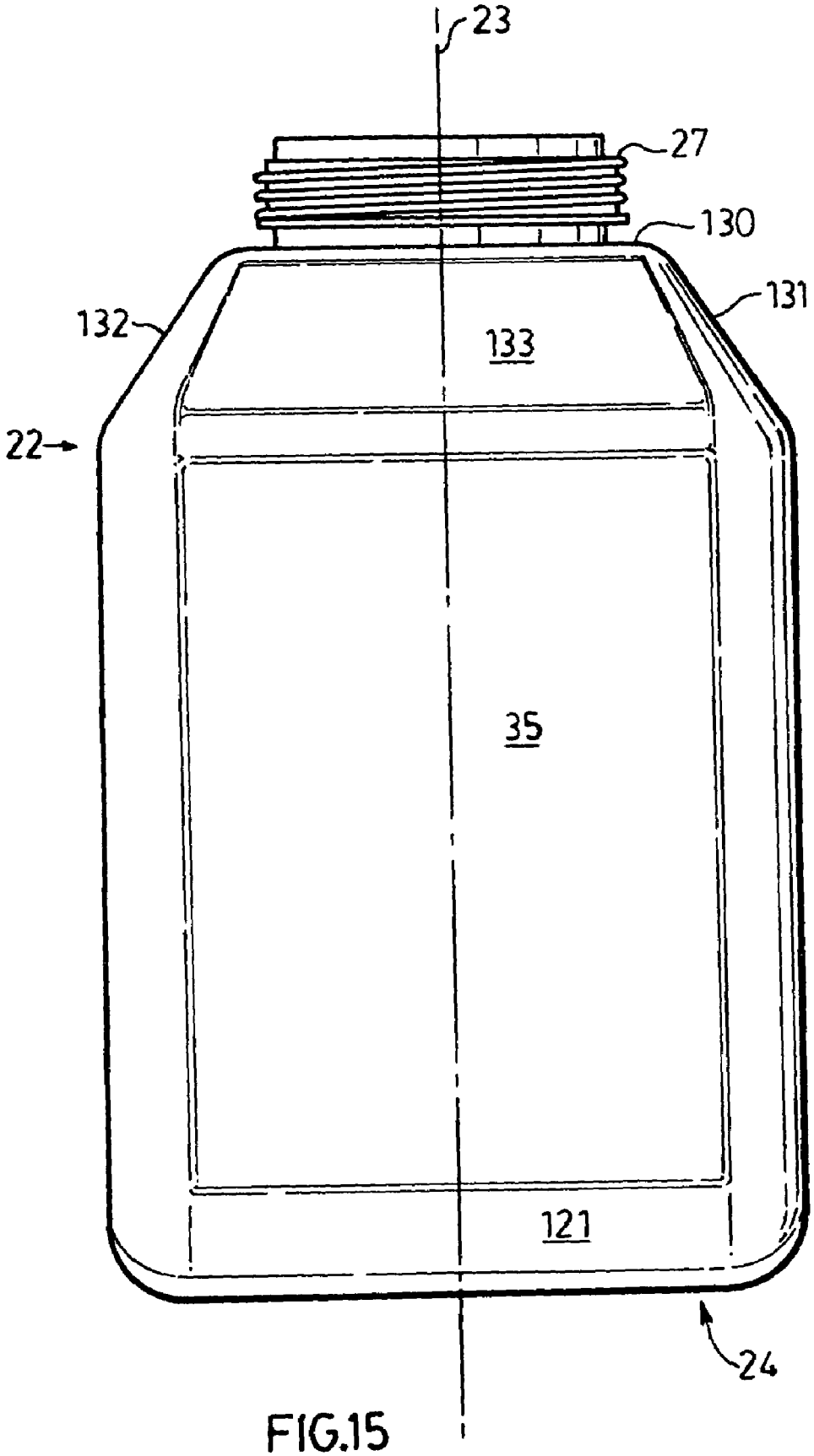
FIG. 15 is a side view of the bottle of FIG. 13.

The container 22 can be manufactured from a continuous tube of plastic material which can be cut into discrete lengths and sealed at one end, as by a linear seal joint extending across the tube, to form the base end 24 of the container 22 before having its interior pressurized to blow mold the tube to form the container 22 of a desired shape. In FIG. 14, the seam which closes the end of the tube is shown as 120 and the seam represents a portion of relatively thicker and more rigid plastic material with increased resistance to bending and deformation than the other portions of the walls of the container other than its threaded opening. The seam 120 extends across the base end 24 away from one side wall 35 towards the other side wall 45.

As seen in side view in FIG. 16, each compartment 30 and 40 has a bevelled portion 121 and 122 of their outboard side walls 35 and 45 which assist in collapsing of the outboard walls 35 and 45 inwardly in the direction of the arrows indicated as 123 and 124. Such collapsing assists in bending the seam 120 to adopt an outwardly convex configuration and minimized fluid in uncollapsed volumes near the seam 120.

The container 22 of FIGS. 13 to 21 has a cylindrical neck 27 ending at a square neck shoulder 130 normal to the central axis 23. The neck shoulder 130 forms the top of a frusto-pyramidal portion with similar trapezpoidal front, back, left side and right side wall portions 131, 132, 133 and 134, respectively, extending axially therefrom and flaring outwardly. The trapezpoidal side wall portions 33 and 34 merge into the outboard side walls 35 and 45, respectively. The trapezoidal front and rear wall portions 131 and 132 merge into the respective front and rear walls. Each front wall and rear wall carries a respective front and rear valley 140, 141 between two lateral shoulders 142, 144 and 143, 145. The valleys have front side valley walls 34 and 44 and rear side valley walls 34 and 44 extending centrally into each front and rear wall towards the other of the front and rear walls to a respective front and rear valley apex, formed by the axial channel members 59 and 60 which extend longitudinally of the container. Each of the front and rear valley 140, 141 extend continuously through and from the closed base end 24 towards the open outlet end 25. The valley apex, being the axial channel members 59 and 60, are spaced from each other and provide the axial channelway 51 along their length from the base end 24 towards the outlet which channelway 51 is open in all collapsed and uncollapsed conditions of the container 22.

The valleys 140, 141 end at their outlet end in a respective front and rear valley end wall portion 135 and 137 each of which bridges between the valley side walls of its respective valley. Each front and rear valley end wall portion 135 and 137 is a generally triangular gusset-like end wall extending from a respective end wall inner center apex 134 and 136 at an end of the respective valley apex 59 and 60 closest to the outlet end. Each valley end wall portion 135 and 137 widens towards the outlet end. Each front and rear valley end wall portions 135 and 137 extend from its center apex diagonally at an angle longitudinally of the container towards the outlet end and outwardly away from the other of the front and rear valley. The front and rear valley apex 59 and 60 are spaced from each other and provide the axial channelway 51 therebetween from the base end 24 to the center apex 134 and 136 of each front and rear valley end wall portion. On collapsing of the container under a vacuum applied to withdraw fluid from the outlet end, the side walls 35 and 45 are drawn together about the front and rear valley apex 59 and 60 with the channelway 51 provided as at least a front continuous channel substantially from the base end 24 adjacent the front valley apex 59 and at least a rear continuous channel substantially from the base end 24 adjacent the rear valley apex 60.

As seen in FIG. 19, the first compartment 30 is defined on a first side of the channelway 51 bounded by an interior of the outboard side wall 35 and the interiors of the front valley side wall 34 and the rear valley side wall 34 opposed thereto, and the second compartment 40 is defined on a second side of the channelway 51 bounded by an interior of the outboard side wall 45 and the interiors of the front valley side wall 44 and the rear valley side wall 44 opposed thereto. Each compartment is in communication with the opening in the outlet end throughout its length longitudinally of the container via the channelway 51 in all collapsed conditions of the container.

In the container 22 of FIGS. 13 to 21, the front wall and rear wall each are generally a symmetrical mirror image of each other and the side walls are generally a symmetrical mirror image of each other.

The trapezoidal front and rear wall portions 131 and 132 merge at their sides with the lateral shoulders 142, 144, 143 and 145 of the front and rear walls and the curved side end portions 110 of the compartments 30 and 40 and merge in their middle into the triangular valley end wall portions 135 and 137 which extend axially from the frusto-pyramidal portion and inwardly to their center apex 134 and 136 at the end of the axial channel members 59 and 60. The triangular valley end wall portions 135 and 137 assist in the outboard side walls 35 and 45 being drawn inwardly towards each other in collapsing. In collapsing, the trapezoidal side wall portions 133 and 134 are drawn inwardly and upwardly under the neck shoulder 130 as indicated by arrows 138 and 139 in FIG. 16.

Figure 22:
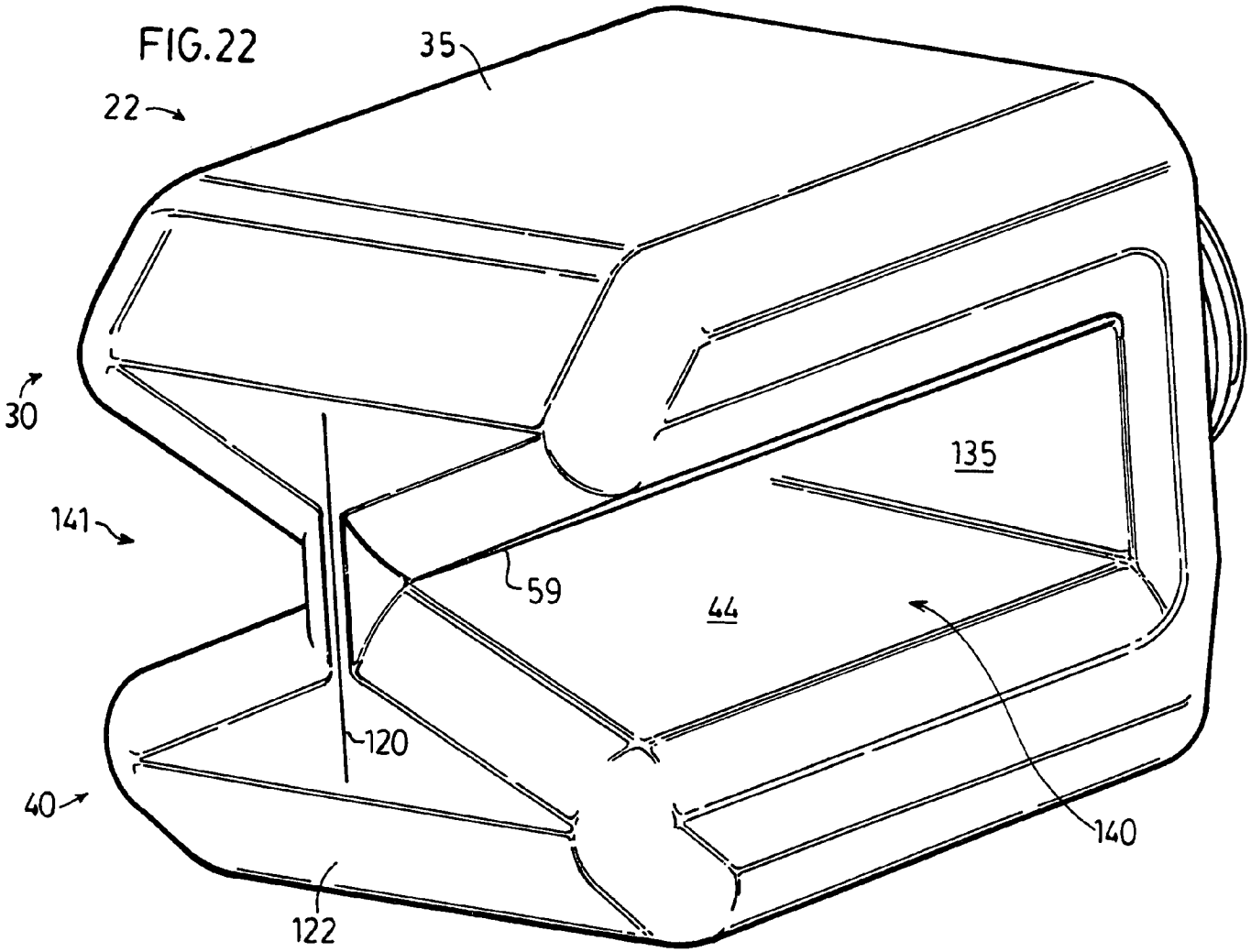
FIG. 22 is a pictorial view of a collapsible bottle in accordance with a seventh embodiment of the invention.
Figure 23:
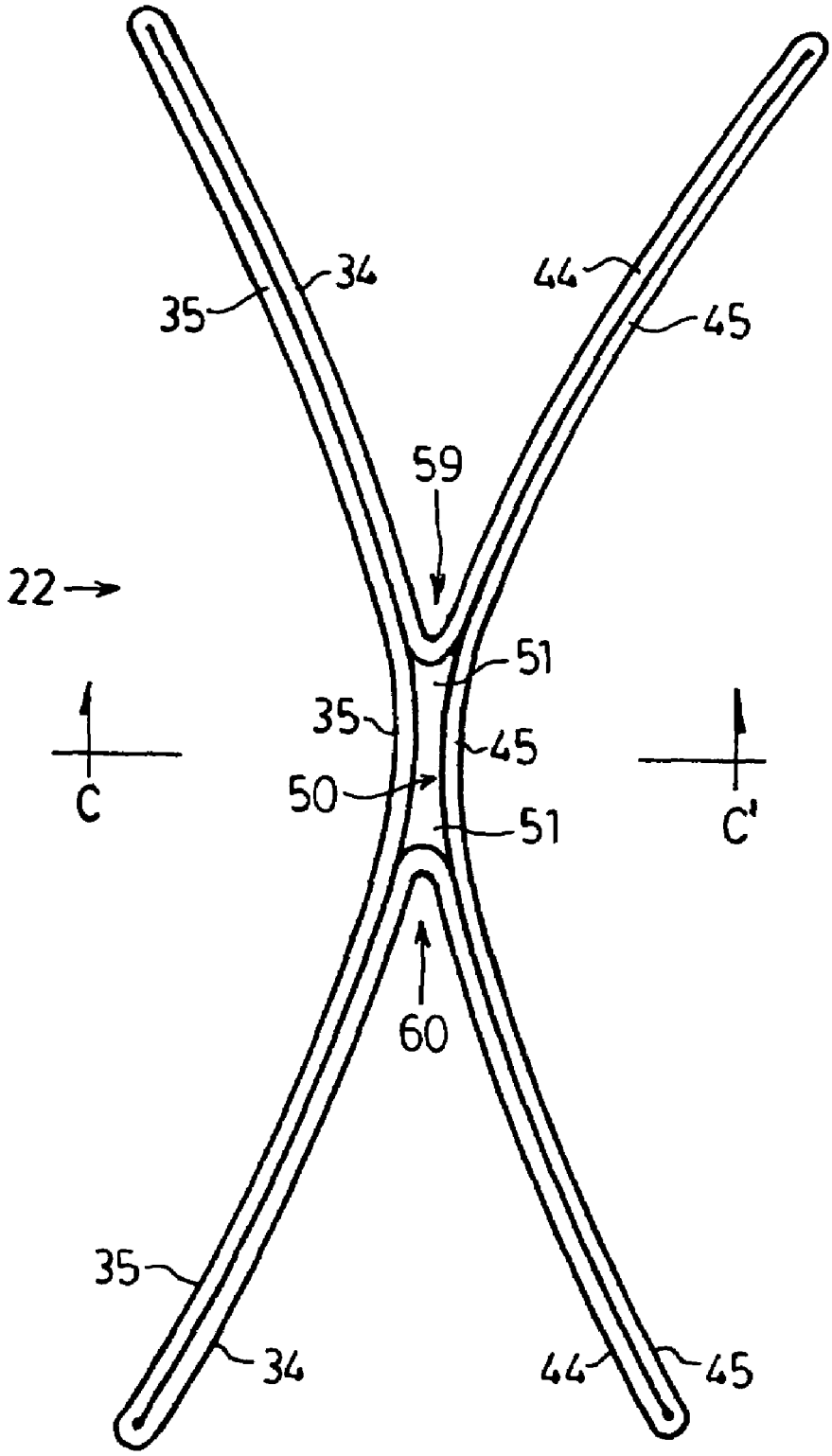
FIG. 23 is a cross-sectional side view similar to FIG. 20 but of the bottle of FIG. 22.
Figure 24:
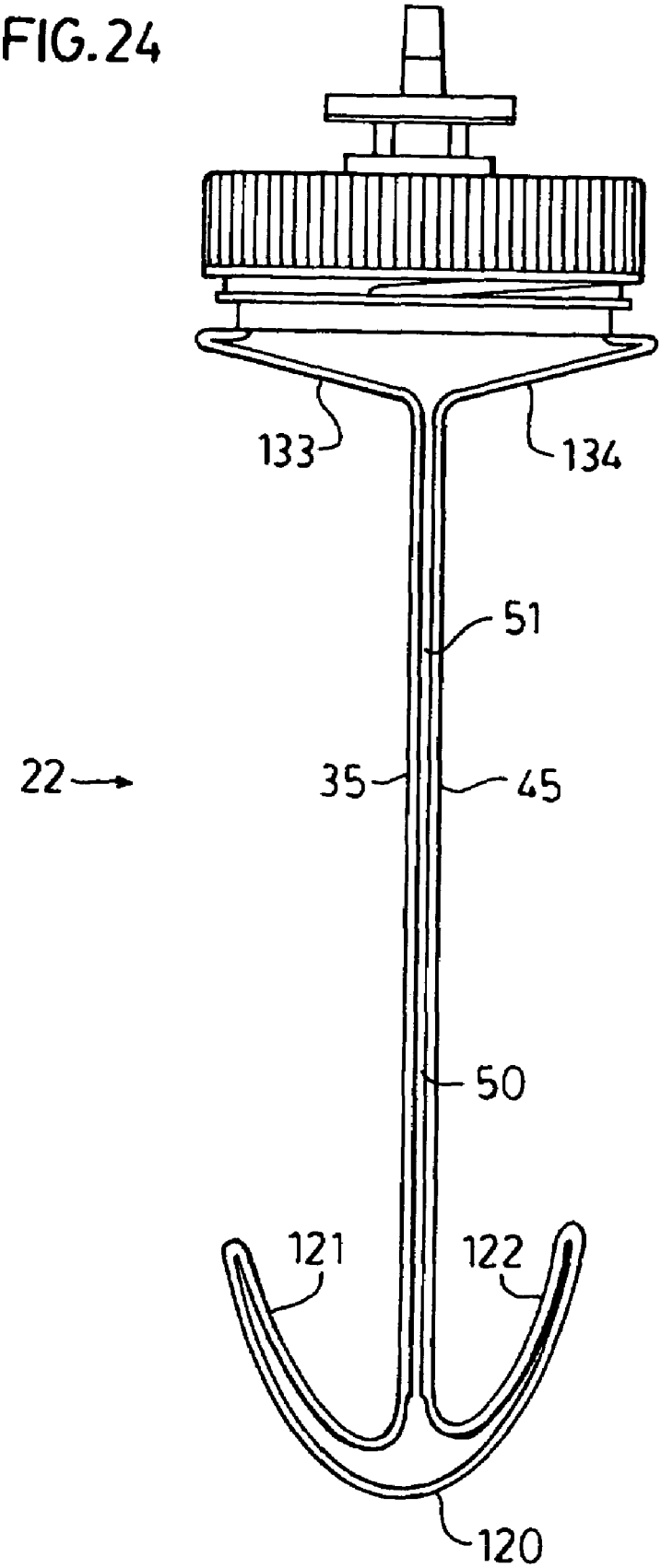
FIG. 24 is a schematic cross-sectional side view along section line C-C' in FIG. 23.

Reference is made to FIGS. 22 to 24 showing a seventh embodiment of the invention which is the same as the sixth embodiment of FIG. 13, however, with the axial channel members 59 and 60 and the lateral channel members 101 and 102 eliminated. As best seen in the collapsed condition in FIGS. 23 and 24, a slotway 50 is kept open with an axially extending channelway 51 therethrough by reason the thickness of the two front valley inboard walls 34 and 44 where they meet at an outwardly convex fold or juncture 59, and by reason of the thickness of the two rear valley inboard side walls 34 and 44 where they meet at an outwardly convex fold or junction 60. At the least, an axial channelway 51 will be formed proximate each of these folds or junctures 59 and 60. FIG. 23 shows a lateral cross-section with the container collapsed and FIG. 24 shows a longitudinal cross-section along section line C-C' in FIG. 23. As seen in FIG. 24, the trapezoidal wall portions 133 and 134 have collapsed inwardly towards each other and the bevelled portions 121 and 122 have collapsed inwardly assisting in forcing the base end 24 and its seam 120 to be bent into a convex curved condition as shown.

While advantageous, such axial channel members 59 and 60 and the laterally extending channel members 102 and 103 may each or both be eliminated from the embodiment of FIG. 13.

The embodiments of FIGS. 13 and 22 show the lateral channel members 102 and 103 carried on the inboard side walls 34 and 35. Such lateral channel members 101 and 102 may be eliminated. If, however, such lateral channel members 101 and 102 are to be provided, they may be provided alternatively or in addition on the outboard side walls 35 and 45.

The lateral channel members 101 and 102 are shown to be part cylindrical outwardly convex portions of the wall. This is not necessary. The purpose of the lateral channel members 101 and 102 is, on collapsing of the outboard side walls 35, 45 into its respective inboard side walls 34, 44, to provide a channelway laterally to the slotway 50. Any formation on either of the walls 35, 45 or 34, 44 which on collapsing of the container provides for such lateral channelways can be advantageous. For example, the lateral channel members 101 and 102 could be outwardly concave or could be inwardly extending ribs, or a line of inwardly extending dimples, each structure being adapted to assist on abutment of the outboard and inboard walls, that channelways are provided to the slotway 50.

The axial channel members 59 and 60 in the sixth embodiment of FIG. 13 are provided to be part cylindrical outwardly convex. This is not necessary. The channel members assist in providing a thickness to the fold between the inboard walls 34 and a thickness to the fold between the inboard walls 44 to assist in providing axially extending channelways 51 which are open when the bottle is collapsed. Having the axial channel members 59 and 60 which resist folding and increase the thickness of the joint or fold between the inboard walls is advantageous and may be accomplished merely by stiffening the material of the joint or fold, or providing it to be concave outwardly or of a thickened seam although this is not necessary.

The collapsible container 22 of the present invention is shown in FIG. 1 as being adapted for use inverted, that is, with the outlet opening 26 pointing downwardly. This is not necessary. With a pump which creates a vacuum in a sealed container 22, fluid may be drawn out in all orientations of the container whether the outlet opening 26 is disposed to be directed downwardly, upwardly, sideways or in any other position.

The containers 22 illustrated in the preferred embodiments have a variety of shapes as seen in cross-section as may the individual compartments 30 and 40.

The container 22 is preferably formed from plastic materials preferably selected from polyethylene, polypropylene and polystyrene.

While the invention has been described with reference to preferred embodiments, many modifications and variations will now occur to persons skilled in the art. For a definition of the invention, reference is made to the following claims.

I claim:

1. A collapsible container having an outlet opening and two collapsible tubular compartments, each compartment extending beside the other compartment from a respective open end of each compartment opening into the outlet opening away from the outlet opening to a respective closed end of each compartment, each compartment having a outboard side and an opposed inboard side with the inboard side of one compartment facing the inboard side of the other compartment, each compartment being collapsible from an inflated condition in which the container is filled with fluid toward a collapsed condition by the withdrawn of fluid from the outlet opening, wherein in the inflated condition, the inboard side and outboard side of each compartment are spaced, and wherein in collapsing from the inflated condition toward the collapsed condition the outboard side and inboard side of each compartment move relatively towards each other, a shunt opening through the inboard sides of the compartments placing the two compartments in communication through their inboard sides, the shunt comprises a plurality of shunt passageways bridging between the inboard sides of the compartments placing the two compartments in communication through their inboard sides at a plurality of locations from the open end to their closed end.

2. A collapsible container as claimed in claim 1 wherein the shunt places the two compartments in communication continuously from their open ends substantially to their closed ends.

3. A collapsible container as claimed in claim 1 wherein in collapsing the outboard side and inboard side of each compartment are drawn together.

4. A collapsible container as claimed in claim 1 wherein each compartment extends about a longitudinal axis from their open end to their respective closed end with the longitudinal axis of each compartment being parallel.

5. A collapsible container as claimed in claim 1 wherein each compartment extending about a longitudinal axis from their open end to their respective closed end with the longitudinal axis of each compartment being parallel, the passageways spaced from each other in a direction the longitudinal axes extend.

6. A collapsible container as claimed in claim 1 wherein the shunt provides communication between containers in all conditions of the containers in collapsing from the inflated condition to the collapsed condition.

7. A collapsible container having an outlet opening and two collapsible tubular compartments, each compartment extending beside the other compartment from a respective open end of each compartment opening into the outlet opening away from the outlet opening to a respective closed end of each compartment, each compartment having a outboard side and an opposed inboard side with the inboard side of one compartment facing the inboard side of the other compartment, each compartment being collapsible from an inflated condition in which the container is filled with fluid toward a collapsed condition by the withdrawn of fluid from the outlet opening, wherein in the inflated condition, the inboard side and outboard side of each compartment are spaced, and wherein in collapsing from the inflated condition toward the collapsed condition the outboard side and inboard side of each compartment move relatively towards each other, a shunt opening through the inboard sides of the compartments placing the two compartments in communication through their inboard sides, wherein the shunt provides communication between containers in all conditions of the containers in collapsing from the inflated condition to the collapsed condition and the shunt is not collapsible.

8. A collapsible container as claimed in claim 1 wherein the passageways provide communication between containers in all conditions of the containers in collapsing from the inflated condition to the collapsed condition.

9. A collapsible container as claimed in claim 1 wherein the passageways are not collapsible.

10. A collapsible container as claimed in claim 1 wherein each compartment extending about a longitudinal axis from its open end to its respective closed end, each compartment having a thickness measured between the outboard side and inboard side normal the longitudinal axis, and a width measured normal to both the thickness and the longitudinal axis, in cross-section normal to its longitudinal axis, each tubular compartment being elongate in its width relative to its thickness.

11. A collapsible container as claimed in claim 1 wherein the container is blow molded from plastic material as a unitary element.

12. A collapsible container as claimed in claim 4 wherein the shunt includes a continuous elongate channelway extending parallel to the longitudinal axis of the compartments between the compartments, the channelway open at one end to the outlet opening, the channelway open on a first side of the channelway through the inboard side of one of the compartment into the one compartment and open on a second side of the channelway through the inboard side of a second of the compartments into the second compartment.

13. A collapsible container having an outlet opening and two collapsible tubular compartments, each compartment extending beside the other compartment from a respective open end of each compartment opening into the outlet opening away from the outlet opening to a respective closed end of each compartment, each compartment having a outboard side and an opposed inboard side with the inboard side of one compartment facing the inboard side of the other compartment, each compartment being collapsible from an inflated condition in which the container is filled with fluid toward a collapsed condition by the withdrawn of fluid from the outlet opening, wherein in the inflated condition, the inboard side and outboard side of each compartment are spaced, wherein in collapsing from the inflated condition toward the collapsed condition the outboard side and inboard side of each compartment move relatively towards each other, a shunt opening through the inboard sides of the compartments placing the two compartments in communication through their inboard sides, each compartment extends about a longitudinal axis from their open end to their respective closed end with the longitudinal axis of each compartment being parallel, the shunt includes a continuous elongate channelway extending parallel to the longitudinal axis of the compartments between the compartments, the channelway open at one end to the outlet opening, the channelway open on a first side of the channelway through the inboard side of one of the compartment into the one compartment and open on a second side of the channelway through the inboard side of a second of the compartments into the second compartment, wherein the channelway is generally cylindrical about a channelway axis parallel the longitudinal axes of the compartments, a plurality of cylindrical passageways spaced along the channelway, a first set of the passageways extending from a first side of the channelway about an axis transverse to the channelway axis from the channelway through the inboard side of the one compartment into the one compartment, a second set of passageways extending from a second side of the channelway about an axis transverse to the channelway axis from the channelway through the inboard side of the second compartment into the second compartment, the plurality of passageways placing each of the two compartments in communication with the channelway through their inboard sides at a plurality of locations from their open ends substantially to their closed ends.

14. A collapsible container as claimed in claim 13 wherein the channelway being substantially non-collapsible and the passageways being substantially non-collapsible such that in the compartments collapsing from the inflated condition toward the collapsed condition, each compartment remains in communication with the outlet opening via the passageways and channelway at multiple locations spaced along their length where the passageways connect with the compartments.

15. A thin walled collapsible container closed but for an opening from an outlet end, the outlet end merging with front, rear and two side walls extending longitudinally of the container away from the outlet end to a closed base end, the front wall and rear wall each carrying a respective front and rear valley having side valley walls extending centrally into each front and rear walls toward a respective other of the rear and front wall to a respective front and rear valley valley apex each extending longitudinally of the container, each of the front and rear valley extending continuing from the base end towards the outlet end toward the outlet end, the front and rear valley apex spaced from each other and providing a channelway therebetween along their length from the base end toward the outlet end in all collapsed and uncollapsed conditions of the container, each of the front and rear valley apex comprising a part-cylindrical wall portion about an axis extending longitudinally of the container, each of the part-cylindrical wall portion providing a portion of the channelway longitudinally therein under all collapsed conditions of the container, and, lateral passageways on the interior of the side walls or the valley side walls extending transversely of the channelway and opening at one end into communication with the channelway.

16. A container as claimed in claim 15 wherein where each front and rear valley ends in a respective front and rear valley end wall which bridges between the valley side walls of its respective of the front and rear valley.

17. A container as claimed in claim 16 wherein each front and rear valley end wall is a respective generally triangular gusset-like end wall extending from a respective end wall inner center apex at an end of the respective valley apex closest to the outlet end and widening towards the outlet end.

18. A container as claimed in claim 17 wherein each front and rear valley end wall extending from its center apex diagonally at an angle longitudinally of the container towards the outlet end and outwardly away from the other of the front and rear valley, the front and rear valley apex spaced from each other and providing the channelway therebetween from the base end to the center apex of each front and rear valley end wall.

19. A container as claimed in claim 18 wherein on collapsing of the container under a vacuum applied to withdraw fluid from the outlet end, the side walls are drawn together about the front valley apex and the rear valley apex with the channelway provided at least as a front continuous channel substantially from the base end adjacent the front valley apex and a rear continuous channel substantially from the base end adjacent the rear valley apex.

20. A container as claimed in claim 15 wherein the outlet end has a frusto-pyramidal portion about the opening at the outlet end with four generally trapezoidal wall portions each merging into one of the front, rear and two side walls.

21. A container as claimed in claim 15 wherein:

a first compartment is defined on a first side of the channelway bounded by an interior of a first of the side walls and the interiors of the front valley side wall and the rear valley side wall opposed thereto, and a second compartment is defined on a second side of the channelway bounded by an interior of a second of the side walls and the interiors of the front valley side wall and the rear valley side wall opposed thereto.

22. A container as claimed in claim 21 wherein each compartment is in communication with the opening in the outlet end throughout its length longitudinally of the container via the channelway in all collapsed conditions of the container.

23. A container as claimed in claim 15 wherein each lateral passageway comprises a lateral part-cylindrical wall portion about an axis extending transversely of the channelway, the lateral part-cylindrical wall portion providing the lateral passageway longitudinally therein under all collapsed conditions of the container.

24. A container as claimed in claim 15 wherein the container comprises a continuous tube of plastic material open at one end comprising the outlet end and closed at another end comprising the base end of the container along a generally linear seal joint extending across the tube, wherein the seal extends across the middle of base end from one side wall toward the other side wall.

25. A container as claimed claim 15 in which the front wall and rear wall each being generally a symmetrical mirror image of each other, the side walls each being generally a symmetrical mirror image of each other.

* * * * *